United States Patent [19]

Delago et al.

[11] Patent Number: 4,579,234

[45] Date of Patent: Apr. 1, 1986

[54] SELF-ERECTING MOBILE CRANE

[75] Inventors: Pierre C. Delago, Afton; Alan A. Meyman, Bloomington; Frank M. Monteiro, Oakdale, all of Minn.

[73] Assignee: American Hoist & Derrick Company, St. Paul, Minn.

[21] Appl. No.: 590,484

[22] Filed: Mar. 16, 1984

[51] Int. Cl.[4] ..... B66C 23/72; B66C 23/06; B66C 23/26

[52] U.S. Cl. ..... 212/178; 212/182; 212/180; 212/186; 212/232; 212/239; 212/244; 212/195

[58] Field of Search ..... 212/175–176, 212/178–179, 180, 182, 186, 195, 223, 227, 233, 239, 244, 255, 260, 262, 265

[56] References Cited

U.S. PATENT DOCUMENTS

| | | | |
|---|---|---|---|
| 1,159,841 | 11/1915 | Holt . | |
| 2,910,189 | 10/1959 | Scheuerpflug | 212/59 |
| 3,485,383 | 12/1969 | Beduhn | 212/48 |
| 3,836,010 | 9/1974 | Lampson | 212/195 |
| 3,842,984 | 10/1974 | Brown et al. | 212/49 |
| 3,930,583 | 1/1976 | Jouffrey | 212/195 |
| 4,081,081 | 3/1978 | Morrow et al. | 212/195 |
| 4,196,816 | 4/1980 | Dvorsky et al. | 212/49 |
| 4,358,021 | 11/1982 | Helm et al. | 212/195 |
| 4,381,060 | 4/1983 | Morrow, Sr. et al. | 212/195 |
| 4,382,519 | 5/1983 | Beduhn et al. | 212/189 X |
| 4,387,814 | 6/1983 | Beduhn et al. | 212/195 |

FOREIGN PATENT DOCUMENTS 1185353 1/1965 Fed. Rep. of Germany .

*Primary Examiner*—Trygve M. Blix
*Assistant Examiner*—R. B. Johnson
*Attorney, Agent, or Firm*—Kinney & Lange

[57] ABSTRACT

A self-erecting traveling crane having a machinery platform rotatably mounted with respect to a carbody utilizes a concentric support ring, a boom foot carrier pivotably mounted to the platform and rolling on the support ring, and a counterweight carrier with trailing counterweight pivotably mounted to the platform and rolling on the ring. A mast and boom are mounted near a forward end of the boom foot carrier. To change location for use, the crane can be rigged to move in forward or rearward direction carrying its support ring. A travel strut is pivotably mounted to an inner end of the boom foot carrier. A boom foot carrier tension pendant extends from the top of the travel strut to an outer end portion of the boom foot carrier. A live boom suspension linkage connects the points of the mast and the boom. Boom suspension pendants extend from the mast point to the trailing counterweight. A gantry is mounted on the machinery platform over a platform counterweight. A live boom foot carrier suspension linkage connects from the top of the gantry to the top of the travel strut. The live linkage of this boom foot carrier suspension linkage connects also to a mast suspension pendant which is connected to the mast point. This linkage is used to raise the mast and the travel strut before the live boom suspension linkage is used to raise the boom. The carriers are each provided with hooks to lift the support ring. To rig for travel, the boom is lowered to cause the counterweight carrier to lift the rear of the support ring off of the ground. The boom is then raised and the live linkage of the boom foot carrier is shortened causing the boom foot carrier tension pendant to raise the front end of the support ring off of the ground.

49 Claims, 52 Drawing Figures

158
156
88
160
154
86
90
162
87
98
126
152
140
150
120
148
74
142
135
78
116
108
106
94
92
102
112
118
110
56

164
82
50
84
94
98
87
86
116
124
54
150
120
162
80
68
74
142
152
144
90
135
136
78
139
138
92

164
82
75°
84
98
66
94
87
126
86
116
124
54
140
146
120
145
74
148
162
142
152
144
90
135
136
139
78
138
92

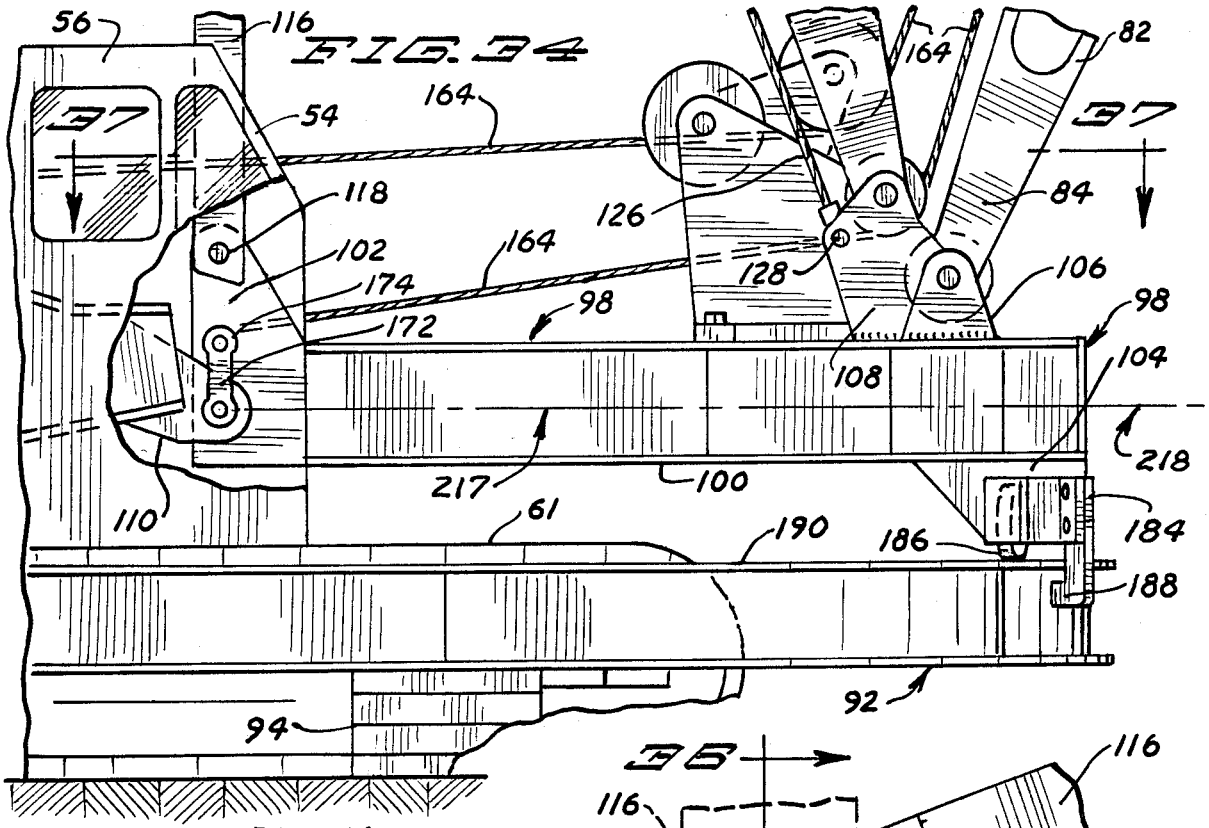
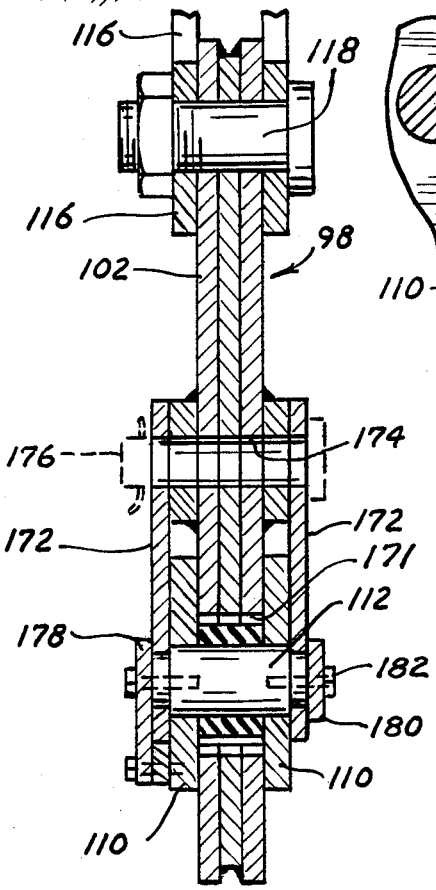
FIG. 36
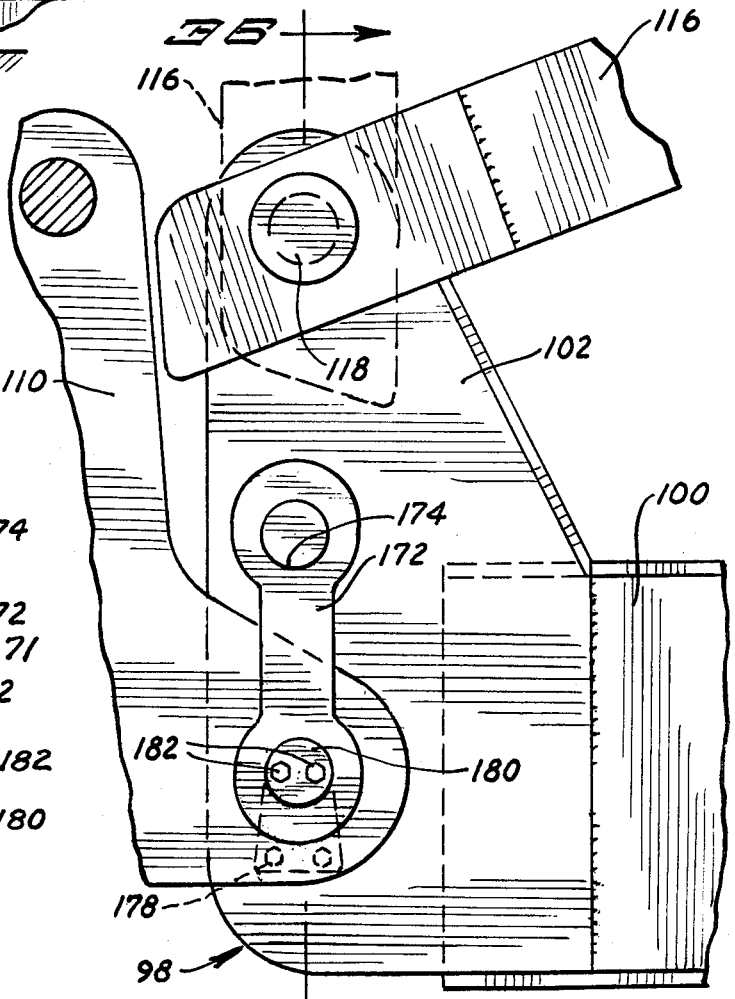
36 → FIG. 35

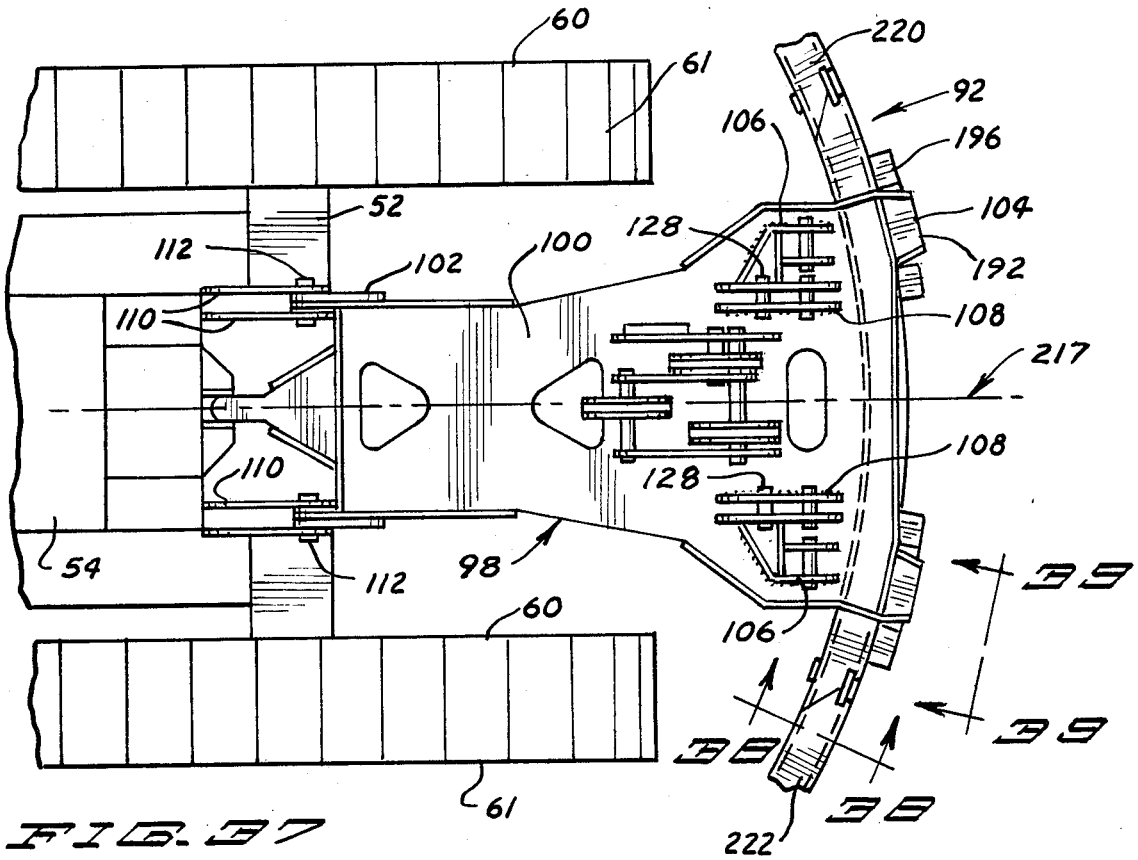
FIG. 37
FIG. 38
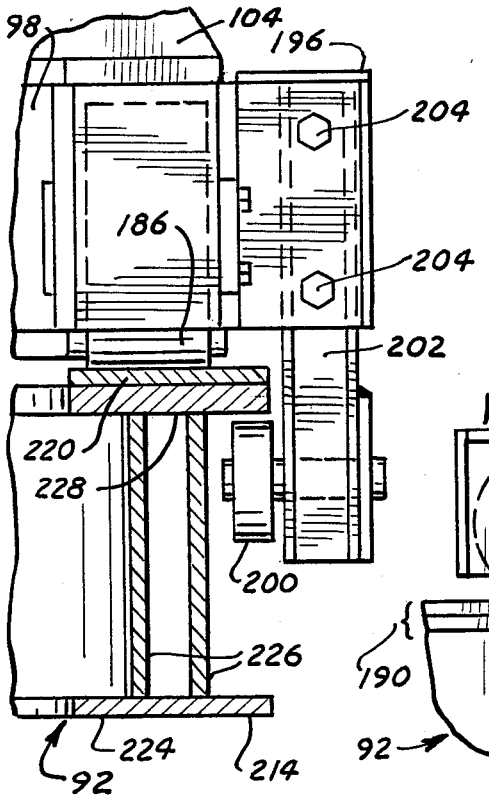
FIG. 39
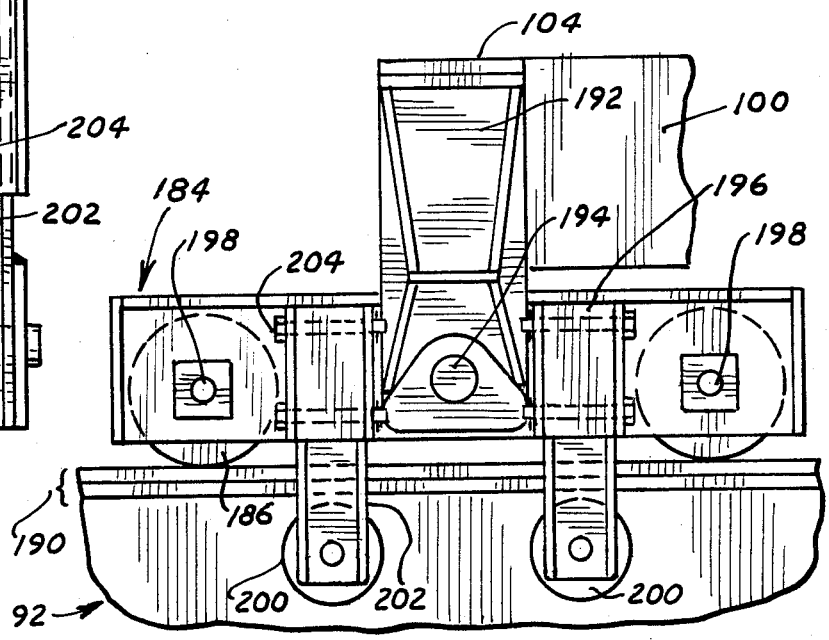

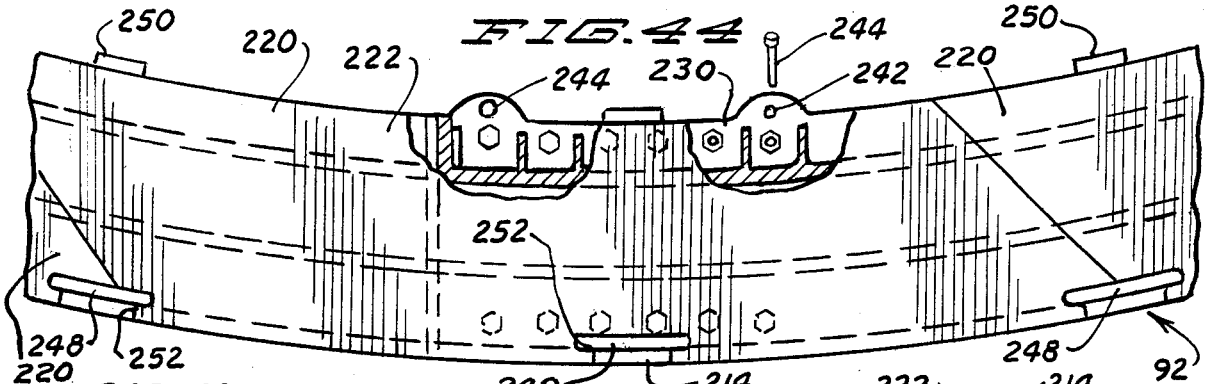
FIG. 44
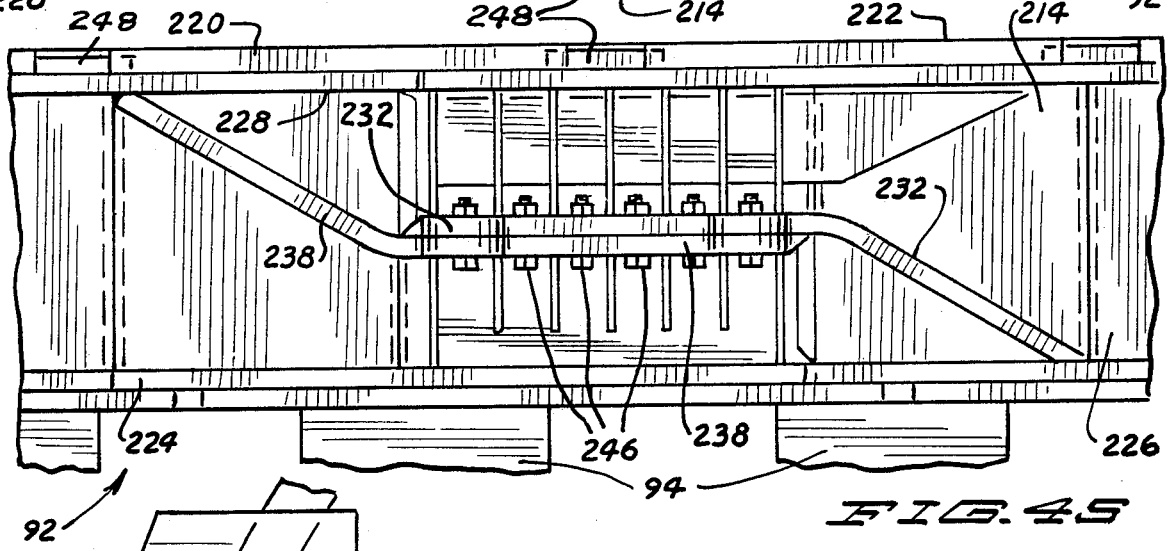
FIG. 45
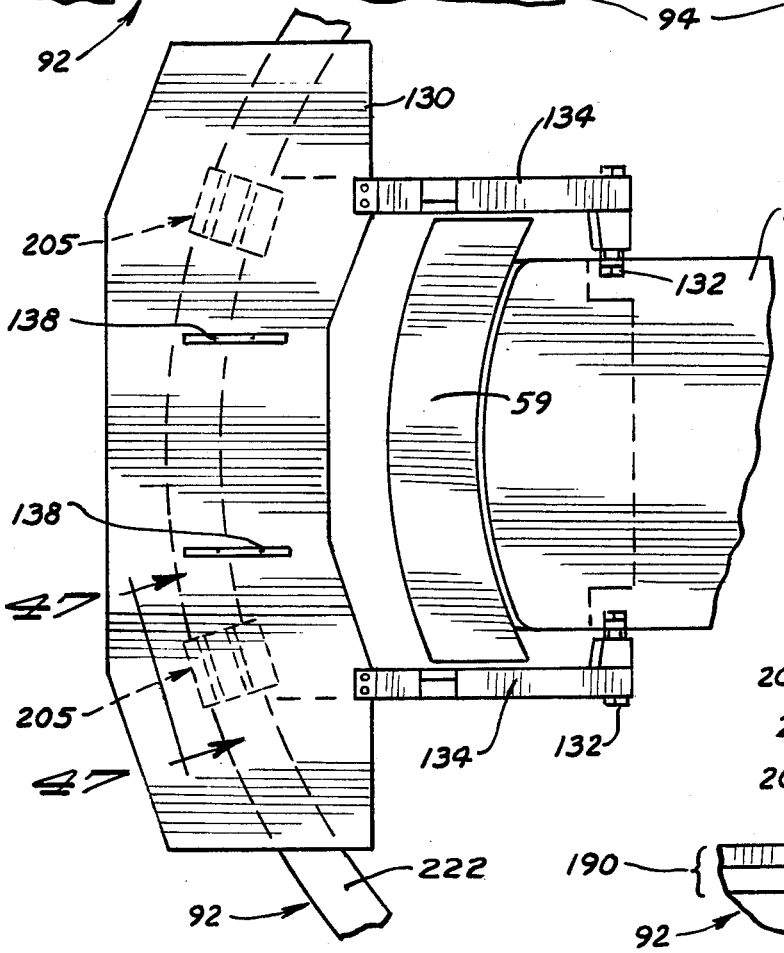
FIG. 46
FIG. 47
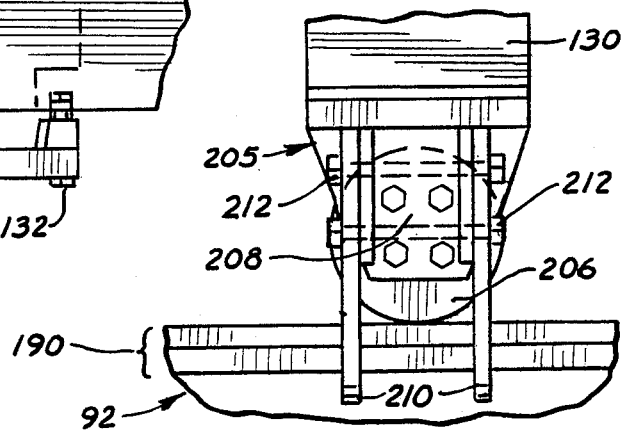

SELF-ERECTING MOBILE CRANE

BACKGROUND OF THE INVENTION

1. Field of the Invention.

This invention has relation to revolver cranes, and more particularly to a crane having a ground supported ring in concentric relation to an upper machinery platform which is rotatably mounted, through a bull gear roller path, on a traction module supported carbody. A boom foot carrier and a counterweight carrier are pivotably mounted to forward and rearward portions of the platform, respectively. A boom and mast are pivotably mounted to the boom foot carrier to be supported for movement along the ring, and a trailing counterweight is supported by the counterweight carrier for movement along the ring.

A conventional crane has a carbody supported on a pair of spaced-apart crawlers, for example, and has a machinery platform which is mounted, through a turntable bearing or bull gear roller path, for rotation on the carbody. A boom is pivotably connected to a forward end of the machinery platform, and a counterweight is secured to the rearward end of the platform. In this configuration, the weight of the load, and the weight of the counterweight, must be transmitted to the carbody (and the ground) through the turntable bearing. Consequently, the load which can be lifted by the crane is limited to a load which can be supported by the machinery platform without damage to the turntable bearing, and/or without exceeding a safe margin on overturning.

2. Description of the Prior Art.

Many efforts have been made in the past to transfer the load carried by the boom, and/or the weight of the counterweight, around (instead of through) the turntable bearing or roller path. See U.S. Pat. No. 4,196,816 to Dvorsky et al, granted in April of 1980.

See also German Pat. No. 1,185,353 to Hans Scheuerpflug, published Jan. 14, 1965. This German Scheuerpflug patent shows a boom foot carrier or intermediate member 2 pivotably mounted to a machinery deck or upper carriage 1 and supported by lateral support rollers 3 on a live support ring 4 which is carried by support plates 5–8 resting on bolsters which are in contact with the ground surface. A jib or boom 10 and a support mast 11 are pivoted on the boom foot carrier 2 so that the vertical components of forces acting on the boom and mast are transmitted directly to the ground. A counterweight 12/13 is supported on a forked lever 14 which extends up the entire length of the machinery deck to be pivoted underneath the boom foot carrier. The forked counterweight support lever 14 is supported at an intermediate fulcrum point by two rollers 16 which are themselves rolling on a separate internal live ring 17 or, in another form of the invention, can roll on and be supported by the same live support ring 4 as is the front end of the boom foot carrier 2.

The patent to Holt, U.S. Pat. No. 1,159,841 granted in November of 1915, shows a machinery platform (or swing frame) rotatably mounted on a carbody (or main frame). The boom is mounted at one end of the machinery platform, and a heavier prime mover (which acts to counterbalance the load) is mounted at the other end of the platform. A pair of slide blocks are mounted under the prime mover, between the machinery platform and the carbody to partially support the load imposed on the machinery platform and transfer that load to the carbody.

The U.S. patent to Scheuerpflug, U.S. Pat. No. 2,910,189, granted in October of 1959, shows a machinery platform mounted for rotation on a carbody. A boom is pivotably mounted at the outermost forward end of the boom foot carrier which, in turn, is pivotably connected at its innermost end to the machinery platform. The boom foot carrier rolls on a support ring which is supported on the ground to transmit the load of the boom directly to the support ring and from the support ring directly vertically to the ground.

The patent to Beduhn, U. S. Pat. No. 3,485,383, granted in December of 1969, shows a crane with a machinery deck mounted for rotation on a carbody. An auxiliary support ring mounted on the ground surrounds the carbody, and supports the outermost end of a boom foot carrier which is pivotably connected at its innermost end to the machinery platform. A boom is mounted at the outermost end of the boom foot carrier directly over the ring to transfer the load of the boom through the support ring to the ground. The machine has two counterweights, one permanently mounted on the machinery platform and one slidably mounted on the machinery platform but supported by the support ring.

The aforesaid patent to Dvorsky et al shows a machinery platform (or upper works) rotatably mounted on a carbody (or lower works). A support ring surrounds the carbody and is connected to it. A rigid rectangular auxiliary frame is mounted on the support ring, surrounding the machinery deck, for rotation on the ring in unison with rotation of the machinery deck. A mast (or gantry) and a boom are pivotably mounted to the auxiliary frame to have position directly over the rollers supporting the frame on the support ring. A counterweight is mounted to the auxiliary frame opposite the mast and boom to be supported directly over rollers supporting the auxiliary frame on the support ring.

The patent to Brown et al, U.S. Pat. No. 3,842,984, granted in October of 1974, shows a crane having a machinery platform which is mounted, through a bull gear roller path, for rotation on the carbody. A mast and a boom are pivotably connected directly to the machinery platform to rotate with the machinery platform on wheel assemblies supported directly on the ground. A machinery platform counterweight is mounted on the rear of the machinery platform.

All of the foregoing serve in one manner or another and to at least some degree to transfer some of the weight of the boom and/or counterweight around (instead of through) the turntable bearing or roller path. However, another important consideration is the minimizing of the ground pressure loading directly under the support ring. The weight of the auxiliary or trailing or supplemental counterweight riding on a ring is a known factor and, therefore, the stresses on the structure under the support ring in alignment with the trailing counterweight can be calculated and the structures can be such that a maximum desired loading of the ground under the trailing counterweight is not exceeded. It would be helpful, however, when the boom is handling its maximum load, if all of this loading was not taken by the support ring and the structure under it and some of it could be transferred back to the machinery platform and even through the turntable bearing or roller path to the carbody.

In the patent to Brown, et al, virtually all of the weight of the trailing counterweight is used to counterbalance the load, and only when most of the weight of the trailing counterweight is utilized does the machinery platform supported counterweight begin to counteract major additional increments of loading. A similar situation appears to exist in connection with the Beduhn patent. A prior art structure is not known in which the trailing counterweight and the machinery platform mounted counterweight each assume part of the counterbalancing of the boom supported load in predetermined equal proportion.

The inventors and those in privity with them are aware of no closer prior art than that set out above, and they are aware of no prior art which anticipates the claims herein.

SUMMARY OF THE INVENTION

A self-erecting traveling crane includes a machinery platform which is mounted, through a bull gear roller path, for rotation on a carbody. The carbody is supported on a pair of traction modules. The crane also includes a ground-supported support ring concentric with the rotational axis of the machinery platform on the carbody. A boom foot carrier is pivotably attached on a horizontal axis to a forward portion of the platform and has an outer end portion supported for movement along the ring. A first platform counterweight is supported on a rearward portion of the platform. A trailing counterweight carrier or tray at the rear of the platform is pivotably attached to the platform and has an outer end portion supported for movement along the ring.

A crane mast and boom are pivotably mounted adjacent the ring supported portion of the boom foot carrier; and a trailing counterweight is supported over the ring on the counterweight carrier. A live first boom suspension linkage connects the upper points of the mast and the boom. A second boom suspension linkage extends between the mast point and the trailing counterweight.

A compression strut assembly, including at least a compression strut and a boom foot carrier tension pendant, extends upwardly from the platform and the boom foot carrier. The compression strut is pivotably mounted on an inner end portion of the boom foot carrier or near the boom foot carrier on the platform. The boom foot carrier tension pendant is fastened between the top of the compression strut and an outer end portion of the boom foot carrier. This pendant is of length to limit the pivotal movement of the strut from a lowered forward position to an upright position.

As shown, the platform supports a gantry extending above the first counterweight. The gantry includes a forwardly mounted gantry mast and a more rearwardly mounted normally stiff gantry backleg connected at its top to the top of the gantry mast. A boom foot carrier suspension assembly including a live third suspension linkage is connected between the top of the gantry and the top of the compression strut.

Also in the form of the invention as shown, a mast suspension assembly is connected between the point of the mast and the top of the gantry and includes the aforesaid live third suspension linkage. In this form of the invention, the live third suspension linkage connects to the gantry, a boom foot carrier suspension pendant extends from said third linkage to the top of the compression strut to form part of the boom foot suspension assembly and a mast suspension pendant extends from the third linkage to the mast point to form part of the mast suspension assembly.

The second boom suspension linkage in the illustrated form of the invention includes a counterweight suspension pendant and boom suspension connecting means. This connecting means is in the form of triangular equalizer plate means which is attached at its top to the bottom of the counterweight suspension pendant, is attached at its forward lower corner to the top of the gantry, and is attached at its rearward lower corner to the top of a trailing counterweight suspenion link. This trailing counterweight suspension link extends upwardly from the counterweight carrier or tray where it is connected in lifting relation to the trailing counterweight.

The support ring has support ring flange means extending outwardly therefrom; and the boom foot carrier and counterweight carrier are each provided with downwardly extending hook means configured to pass around the support ring flange means to location under said flange means whereby upward movement of outer end portions of the boom foot carrier and/or the counterweight carrier will exert lifting forces on the portions of the support ring flange means contacted by such carrier hook means.

The mast suspension assembly is used to erect the mast by shortening the live third suspension linkage. Because of the connection of the boom foot carrier suspension pendant to the live third suspension linkage and to the top of the compression strut, the compression strut assembly will be erected at the same time. As the mast is erected, the live first boom suspension linkage, is paid out and extended to leave the boom on the ground but to help control the movement of the mast as it moves past vertical and falls back on the mast erection assembly. An extensible mast stop can be provided as part of the mast erection assembly as a backup should the boom foot carrier tension pendant be disconnected or fail.

After the mast moves or is moved to position against the mast erection assembly, the counterweight carrier suspension pendant can be pinned to the equalizer plate. At this point, the mast suspension pendant will be slack. To raise the boom, the live first boom suspension linkage will be shortened. With the boom so raised, the crane will then be in normal and operating configuration.

To prepare for travel in a forward and/or rearward direction, most of the weight of the trailing counterweight will be removed. The live third linkage will be slacked off, and then the boom will be lowered to cause the remaining trailing counterweight, counterweight carrier and aligned portions of the support ring and flange means to be raised. At that point, a trailing counterweight support travel pendant, which has been hanging freely from the top of the gantry, will be fastened in weight supporting relation to the counterweight carrier, and the gantry backleg will be disabled from resisting a compressive load by removing a gantry backleg pin from two mutually telescoping portions of the gantry backleg, for example.

Blocking under the raised rear half of the support ring will now be removed, and then the boom will be raised to its travel position. In the form of the invention shown, stabilizing links will be connected between the boom foot carrier and the machinery platform to prevent any pivoting of the boom foot carrier about its longitudinal center line or axis.

The live third linkage will next be shortened to cause the entire compression strut assembly to pivot about the lower end of the compression strut and to thereby cause the boom foot carrier tension pendant to raise the outer end of the boom foot carrier and the aligned portions of the support ring and flange means from the support ring blocking. Blocking under the raised forward half of the support ring can now be removed and the crane is then in configuration and position to move, whether or not powered by its traction modules, in a forward and/or rearward direction.

BRIEF DESCRIPTION OF THE DRAWINGS

FIG. 26 illustrates the crane of the invention in its working configuration to be used for its intended purpose to lift, swing and lower very large loads;

FIG. 29 illustrates the crane configuration after the lock-up pins of FIG. 28 have been installed with a part of the counterweight removed and before other modifications to permit such travel;

FIG. 30 illustrates the step of booming down to lift the rear semi-circle of the support ring off of the support blocking;

FIG. 31 is an enlarged fragmentary side elevational view of the structure of FIG. 30, and illustrating the connection of a pair of counterweight support travel pendants to a counterweight tray;

FIG. 32 illustrates the steps of lifting the front half of the support ring off of its blocking, this then being the configuration in which the crane can move in forward or rearward direction;

FIG. 33 is a side elevational view used to illustrate and describe the process of returning the crane to its ring-supported working configuration;

FIG. 34 is an enlarged fragmentary view with parts broken away and showing the relative positioning of the carbody, boom foot carrier assembly, support ring, machinery platform, ring support blocking and a side frame traction module when the crane is in its working configuration as seen in FIG. 27;

FIG. 35 is a further enlarged fragmentary view of some of the parts of FIG. 34, with parts broken away showing the relative positioning of the inner end of the boom foot carrier, existing boom foot receiving plates on the machinery platform, a travel strut, the boom foot carrier lockup links, and the boom foot carrier lockup pins when the crane is in configuration for the mast suspension assembly to erect the mast as seen in FIGS. 19 and 19A;

FIG. 36 a vertical sectional view taken on line 36—36 in FIG. 35;

FIG. 37 is an enlarged fragmentary top plan view of a front portion of the crane of the invention and showing the details of the boom foot carrier assembly substantially as they appear from the top in FIG. 10;

FIG. 38 is an enlarged fragmentary vertical sectional view taken on line 38—38 in FIG. 37 showing hook rollers positioned under an upper flange of the support ring, these rollers being a modification of the form of the hook as illustrated in the preceding views;

FIG. 39 is an enlarged fragmentary elevational view of the boom foot carrier roller support assembly of FIGS. 37 and 38 taken on the line 39—39 in FIG. 37;

FIG. 44 is an enlarged fragmentary view with parts broken away of a portion of a top fastening and a bottom fastening support ring segment bolted to each other and showing fragments of three ring cover plates fixedly positioned on the upper flange of the supporting ring;

FIG. 45 is a fragmentary exterior side elevational view of the bolted splice connection between ring segments and of ring cover plates supported thereon;

FIG. 46 is a fragmentary top plan view of a trailing counterweight tray showing its relationship to a fragment of the rotatable machinery platform, a first machinery platform counterweight supported on the platform, and a fragment of the support ring;

FIG. 47 is an enlarged fragmentary elevational view of a roller and hook assembly supporting the counterweight tray for rolling movement along a ring path on the top of the supporting ring taken on line 47—47 in FIG. 46;

DETAILED DESCRIPTION OF THE PREFERRED EMBODIMENT

Figure 1:
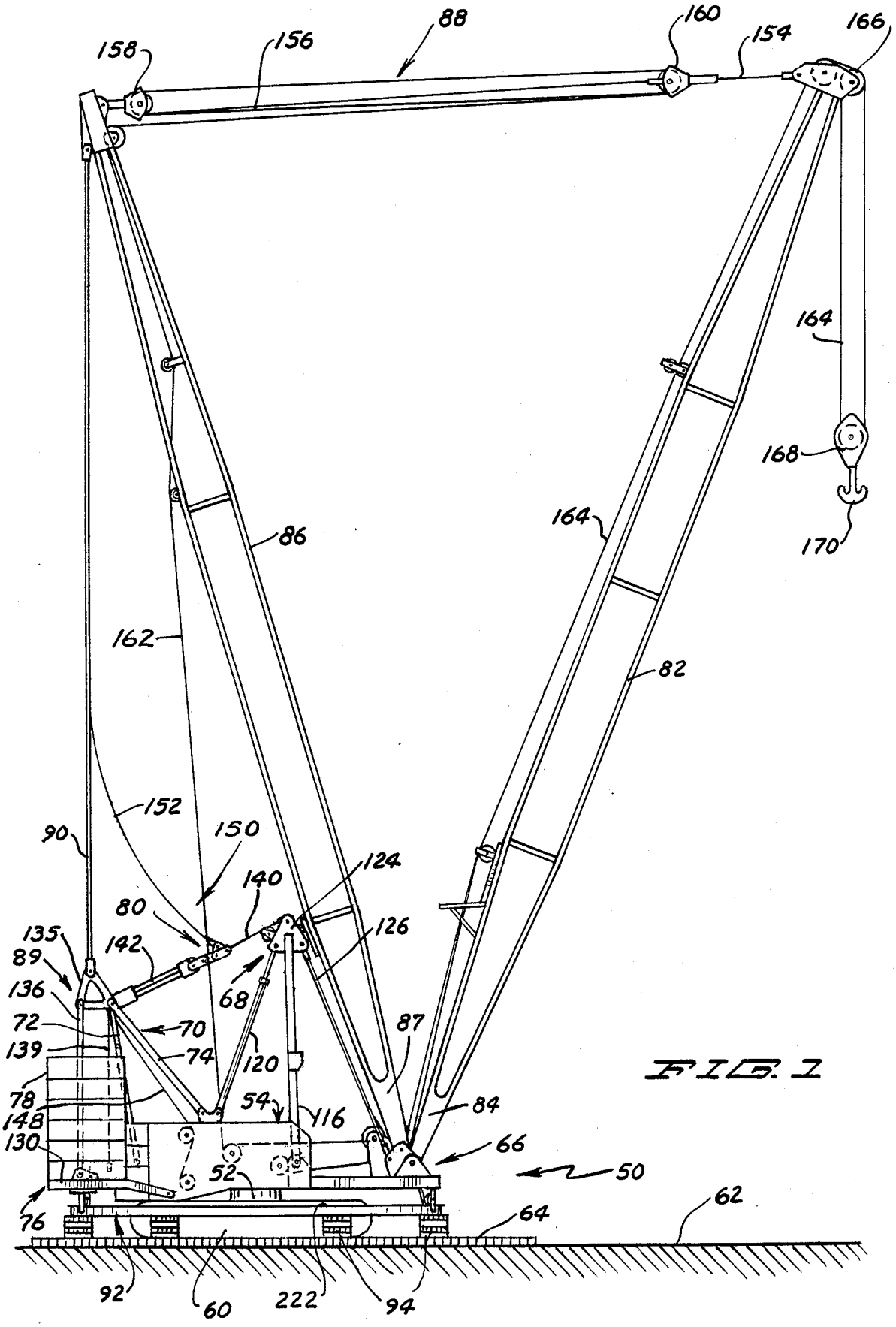
FIG. 1 is a side elevational view of a crawler crane made according to the present invention in position to hoist a maximum load and to rotate with that load before delivering it to a location for use.

A crawler crane 50 of the present invention includes a carbody 52 rotatably supporting a machinery platform 54 on a bull gear roller path 55. The platform includes an operator's cab module 56 and a machinery cab module 58. Machinery platform 54 supports a first machinery platform counterweight 59. The carbody 52 is supported on a pair of side frame traction modules 60,60 which include track shoes 61,61.

These traction modules are supported on the surface of the ground 62 or other relatively flat horizontal surface. For the purposes of the invention, it will be helpful to compact the soil to withstand a maximum pressure of 140 pounds per square inch, and to lay a mat of 12"×12" oak timbers 64 or the like on the surface of the ground before positioning the traction modules 60,60 thereon.

Crane 50 includes a boom foot carrier assembly 66; a travel strut and mast erection assembly 68; a gantry or A-frame assembly 70 made up of a gantry backleg 72 and a gantry or A-frame mast 74; a trailing counterweight assembly 76; a second trailing counterweight 78 supported on the trailing counterweight assembly 76; and a boom foot carrier suspension assembly 80 connected between the top of gantry or A-frame assembly 70 and the top of the travel strut assembly 68.

A boom 82 includes a boom foot 84 which is pivotably mounted to a forward or outer end portion of the boom foot carrier assembly 66. A mast 86 includes a mast foot 87 which is also pivotably mounted to the outer end portion of the boom foot carrier assembly 66.

As shown, the mast foot 87 and boom foot 84 are mounted at a forward end portion, spaced somewhat back from position directly at the front end of the boom foot carrier.

A first boom suspension linkage 88 is connected between upper ends or points of the boom and mast. A second boom suspension linkage 89 includes counterweight carrier suspension pendant means or second boom suspension pendant means 90 connected at its upper end to the upper end of the mast 86, and at its lower end to upper portions of gantry assembly 70 and trailing counterweight assembly 76 when the crawler crane is in its operative, working configuration to lift a very heavy load, to swing it and to lower it.

To handle such very heavy loads, crawler crane 50 is provided with a very sturdy and rigid support ring assembly 92 which is supported on a series of blocking stanchions 94 in the form of the invention as shown. The support ring assembly 92 is supported to be in concentric relation to a vertical axis 96 of rotation of the machinery platform 54 with respect to carbody 52. See FIG. 10.

The structure of the boom foot carrier assembly 66 is seen in various details in FIG. 19A and FIGS. 34 through 39. Boom foot carrier assembly 66 includes a boom foot carrier 98 which is made up of a main frame 100, a pair of inner end carrier pivot plates 102,102, an outer end load roller support frame 104, boom foot mounting pivot plates 106,106, mast foot mounting pivot plates 108,108, and appropriate plates for mounting load line sheaves. The longitudinal axis or center line of the boom foot carrier 98 is designated 217.

As best seen in FIGS. 34, 35 and 36, the inner end carrier pivot plates 102 are each pivotably mounted, through the instrumentality of boom foot carrier pivot pins 112,112, between a pair of so-called boom foot receiving plates 110,110 which extend forwardly from the machinery platform 54. See FIGS. 36 and 37. These so-called boom foot receiving plates 110,110 are used to mount a boom and a mast when the machinery platform is assembled with other components of more usual construction forming no part of the present invention.

The travel strut and mast erection assembly 68 includes a pair of travel or compression struts 116,116 (one is shown) pivotably mounted on pins 118,118 in upper end portions of inner end boom carrier pivot plates 102,102; extensible mast stops 120,120 (one is shown) pivotably mounted as at 122 adjacent the foot of the gantry mast 74 and each pivotably mounted to one of a pair of travel strut assembly links 124,124 each integrally attached to the top of one of the travel struts 116; and a pair of boom foot carrier tension pendants 126,126 (one is shown) each connected between one of the links 124 and mast foot mounting pivot plates 108 as at 128. See FIG. 34, for example.

The trailing counterweight assembly 76 includes a counterweight tray 130 pivotably mounted as at 132 to the machinery platform 54 through the instrumentality of forwardly extending counterweight tray connecting arms 134,134. The trailing counterweight assembly 76 also includes second boom suspension connecting means or triangular suspension equalizer plates 135 (one is shown) pivotably connected at a forward corner to the top of the gantry assembly 70 at the intersection of the gantry back leg 72 and the gantry mast 74; trailing counterweight suspension links 136,136 each pinned at an upper end to a rearward corner of equalizer plates 135 and at a bottom end to one of a pair of trailing counterweight suspension plates 138,138 extending integrally upwardly from spaced apart intermediate portions of counterweight tray 130. See FIG. 46.

The second boom suspension pendant means or counterweight carrier suspension pendant means 90 is made up of a plurality of pendants (one is shown) which are pinned to top corners of the second boom suspension connecting means or triangular suspension equalizer plates 135,135.

A pair of counterweight support travel pendants 139,139 (one is shown) are also pinned from the forward corner of the suspension equalizer plates 135, and when the crane is in normal working configuration, hang freely from that point. When the crane is in travel configuration to move in forward or rearward direction, however, these travel pendants 139 will be connected to the trailing counterweight suspension plates 138,138.

The gantry backlegs 72 of A-frame assembly 70 are, except when the crane is rigged for traveling, of fixed length between their pivotal connections to equalizer plates 135 to their connection at the rear of the machinery platform 54. However, in order to rig the crane for traveling, it is necessary that these A-frame backlegs be disabled from taking compression. Therefore, the gantry backlegs 72 are comprised of upper and lower portions telescoping one within the other, and a gantry backleg pin 73 normally extends through the two telescoping portions to prevent longitudinal movement of the parts with respect to each other except when the crane is being rigged for traveling at which time the pin is removed.

Boom foot carrier suspension assembly 80 includes boom foot carrier suspension means disclosed here as a pair of boom foot carrier suspension pendants 140,140 (one is shown) each pinned on one end to the top of one of the travel strut assembly links 124; carrier/mast luffing 142 having an inner bail 144 connected between the forward corners of the suspension equalizer plates 135,135 and having an outer bail 145 connected to lower rearward corners of a pair of triangular carrier/mast suspension links 146,146 (one is shown). A carrier/mast luffing line 148 forms a part of the carrier/mast luffing 142 and extends downwardly from inner bail 144 to be wound on an appropriate drum located on the machinery platform.

Rearward ends of the boom foot carrier suspension pendants 140,140 are connected to lower forward corners of the carrier/mast suspension links 146,146.

A mast suspension assembly 150 includes the carrier/-mast luffing 142; and mast suspension pendants 152,152 (one is shown) connected at their top ends, along with the counterweight carrier suspension pendants 90, to the point of the mast 86 and connected at their bottom ends to top corners of the triangular carrier/mast suspension links 146,146. Links 146 also form part of the mast suspension assembly 150.

First boom suspension linkage 88 includes first boom suspension pendants 154,154 (one is shown), each connected at an outer end to the boom point; and boom suspension luffing 156 having an inner bail 158 connected to the mast point and an outer bail 160 supported between inner ends of first boom suspension pendants 154,154. A first boom suspension luffing line 162 forms a part of the boom suspension luffing 156 and extends over appropriate sheaves to be wound onto and controlled by appropriate powered drum means on machinery platform 54.

A load handling line 164 extends from appropriate load line drum means on the machinery platform 54, through appropriate sheaves up the boom 82, between a boom point block 166 and a load block 168. Load handling means or load hook 170 extends downwardly from load block 168.

At certain stages during the process of erecting the mast 86, the boom foot carrier is blocked to prevent it from pivoting upwardly about its pivot pins 112,112. How this is accomplished is best seen in FIGS. 19, 19A, 20 and 35. With the mast 86 pivotably mounted to a forward portion of the boom foot carrier assembly 66, with the travel strut and mast erection assembly 68 and the boom foot suspension assembly 80 in place, the travel struts 116 will be leaning forward and resting on two of the mast foot mounting pivot plates 108,108 (see FIG. 19A). Lower ends of the travel struts 116,116 are positioned to be in longitudinal alignment with upper portions of the so-called boom foot receiving plates 110,110 as best seen in FIG. 35. Any tendency for the outer end portion of the boom carrier assembly 66 to lift due to forces on the boom point caused by the shortening of carrier/mast luffing 142 will be immediately resisted by the lower or butt end of the travel strut 116 coming into interfering relation with upper portions of aligned so-called boom receiving plates 110,110 on the machinery deck 54. As the mast is lifted, for example, to slightly beyond the point shown in FIG. 20, the downward vertical component of the mast axial force will insure that the boom foot carrier 98 of the boom foot carrier assembly 66 will have no further tendency to upward movement, so that when the structure reaches the point in FIG. 21 and travel struts 116,116 move to clearing relationship with respect to plates 110,110, this restraining action will no longer be needed.

When the crane is rigged in its working configuration as seen in FIG. 26, it is essential that the outer end load roller support frame 104 of the boom foot carrier 98 of the boom foot carrier assembly 66 follow any and every irregularity of the uppermost continuous ring roller path of the support ring assembly 92 without putting undue strain on the boom foot carrier assembly 66 or the machinery platform 54. This is accomplished by mounting the boom foot carrier assembly 66 to the machinery platform 54 in such a manner that the boom foot carrier 98 can pivot or wobble about the longitudinal axis or center line 217 of the boom foot carrier assembly 66. See FIGS. 34 and 37. To provide for this movement, openings 171 in the inner end carrier pivot plates 102 of the boom foot carrier for receiving boom foot carrier pivot pins 112 are vertically elongated to permit inner end boom foot carrier pivot plates 102,102 to move slightly upwardly and downwardly with respect to the pins 112 and with respect to so-called boom foot receiving plates 110,110.

However, when the crane is configured as shown in FIG. 32 for traveling in forward or rearward direction, the support ring support 92 is being carried by the machinery platform 54 through the instrumentality of the boom foot carrier assembly 66 and the trailing counterweight assembly 76. At this point, no pivoting movement about the longitudinal axis or center line 217 of boom foot carrier assembly 66 can be tolerated.

To eliminate the relative movement between the inner end carrier pivot plates 102,102 and the so-called boom foot receiving plates 110,110, a pair of carrier lock-up links 172,172 are provided. As best seen in FIG. 36, these lock-up links have bottom openings which fit snugly on narrowed cylindrical concentric outer end portions of each of the boom foot carrier pivot pins 112, and have circular top openings each in alignment with a lock-up pin receiving opening 174 provided in each inner end carrier pivot plate 102. A lock-up pin 176 is provided to be inserted through the top openings in the links 172,172 and through lock-up pin receiving openings 174 to positively immobilize the boom foot carrier assembly 66 from rotation about its center line 217.

To prevent the boom foot carrier pivot pins 112,112 themselves from rotating with respect to the so-called boom foot receiving plates 110,110 of machinery platform 54, an elongated pivot pin rotation preventing bar 178 is bolted to one of the boom foot receiving plates 110, and is bolted into the end of the pivot pin 112 itself. See FIG. 36. On the other side, a lock-up link retaining disk 180 is likewise bolted into the pivot pin 112 through the instrumentality of bolts 182,182 to hold one of the lock-up links 172 firmly on its pin 112.

In FIG. 34, lock-up pin 176 has been omitted so the boom foot carrier 98 is free to pivot about its center line 217. In FIG. 36, the lock-up pin 176 has been illustrated in dotted lines, and in FIG. 28, the lock-up pin is shown in place thus locking the boom foot carrier 98 against rotation with respect to the center line 217 of the boom foot carrier.

The outer end roller support frame 104 of boom foot carrier 98 supports a roller pressure equalizer assembly 184. This assembly is seen is FIG. 34 to include boom foot carrier support rollers 186, and removable boom foot carrier retaining hooks 188. The hooks 188 are adjustable to provide clearance between an upper flange 190 of support ring assembly 92 and the hooks 188. See FIG. 34. This structure is illustrated throughout FIGS. 1 and 10 through 34.

However, an alternate structure is shown in FIGS. 37, 38 and 39. In those figures, the outer end load roller support frame 104 includes a pair of downwardly extending roller support brackets 192,192. To each of those brackets 192 is pivotably mounted as at 194 to a hook roller or carrier retaining hook bracket 196. Rollers 186 are rotatably supported as at 198 at opposite ends of the hook roller or carrier retaining hook bracket 196; and a pair of hook rollers 200 and each hook roller support strap 202 on which they are rotatably mounted are removably, adjustably, fixedly positioned in the roller support bolster 196 by pins 204.

As seen in FIG. 47, counterweight tray 130 is supported on support ring assembly 92 on a counterweight tray supporting assembly 205 which includes two counterweight support rollers 206 (one is shown), each rotatably mounted on a roller support bracket 208 extending integrally downwardly from the counterweight tray 130. A pair of counterweight tray retaining hooks 210,210 are pinned to each roller support bracket 208 as at 212 to be easily removable therefrom.

The details of construction of support ring assembly 92 are shown in FIGS. 40 through 45. The support ring assembly includes a support ring 214 made up of three top fastening segments 216 and three bottom fastening segments 218, each effectively spanning 60° of the full support ring circle. Also part of the support ring assembly 92 are a series of interfitting ring cover plates 220 fixedly positioned on top of the support ring 214. The upper surface of these ring cover plates forms a continuous ring roller path 222 for support of the forward end of the boom foot carrier 98 and the counterweight support assembly 205 of the trailing counterweight assembly 76.

The support ring 214 is provided with a bottom flange 224, a central web 226, and a top flange 228. This top flange 228 and an outer exterior edge portion of the interfitting continuous ring cover plates 220 form the upper flange 190 of the support ring assembly 92. As previously stated, the vertical distance below the boom foot carrier support rollers 186 and the upper edge of the retaining hooks 188 or hook rollers 200 is to be sufficient so that these hooks or hook rollers are in clearing relation to the lower surface of flange 190. A clearance distance of something less than ⅜" has been found to be satisfactory. A similar fixed clearance is provided below upper flange 190 and the counterweight tray retaining hooks 210,210.

The steps and procedures involved in assembling the support ring assembly 92 are detailed below. Details of the actual splicing are set out here. A top fastening section 216, to the right as seen in FIGS. 44 and 45, and a bottom fastening section 218, to the left as seen in those figures, are supported on blocking stanchions 94 in overlying relationship to each other.

Outwardly extending intermediate interior and exterior flanges 230 and 232, of top fastening section 216 each are welded to and extend from one of the two vertical walls which make up the central web 226. Vertical reinforcing ribs 234 extend integrally outwardly from web 226 and downwardly from the underside of top flange 228 to support a horizontal portion of each of the intemediate interior and exterior flanges 230 and 232. Similarly, outwardly extending intermediate interior and exterior flanges 236 and 238, of bottom fastening section 218 provided with horizontal portions which are braced by vertical reinforcing ribs 240.

As best understood from FIGS. 44 and 45, the horizontal portions of exterior flanges 232 and 238 lie in contact with each other when top fastening and bottom fastening ring segments are to be joined. Matching bolt holes are provided through these flanges. Interior flanges 230 and 236 are similarly positioned and are also provided with matching bolt holes. The ring segments are so constructed that they are in accurately spaced relationship to each other when the bolt holes in interior flanges 230 and 236 are aligned with each other and when the bolt holes in exterior flanges 232 and 238 are aligned with each other. In order to provide for positive alignment of these interior and exterior flanges of the segments 216 and 218, both the interior flange 230 of section 216 and the interior flange 236 of section 218 are provided with a pair of mutually aligned dowel pin openings 242. When the segments have been aligned as closely as possible, dowels 244 will be forced into dowel pin openings 242, to achieve perfect mutual alignment between the segments, and splicing bolts 246 will be inserted into the flange bolt holes, appropriate nuts installed on the bolts and the two torqued up tight to constitute the two, then spliced, segments as one unitary ring segment. This procedure will be repeated at appropriate intervals in the assembling of the crane to achieve a completely rigid support ring 214.

As best seen in FIGS. 40 through 43, a plurality of exterior ring cover plate spacing bosses 248 extend integrally upwardly from support ring top flange 228 in slightly spaced relation to the exterior edge of that flange; and a plurality of interior ring cover plate retaining bosses 250 are welded to the interior edge of support ring top flange 228 and extend upwardly therefrom. As best seen in FIGS. 44 and 45, the ring cover plates 220 are all provided with appropriate T-slots 252 to receive the spacing bosses 248, and each cover plate rests against the interior surface of at least two of the retaining bosses 250 to the end that the cover plates cannot creep or otherwise move with respect to the top flange 228 of the support ring 214 under operating load.

ERECTION AND OPERATION

Figure 2:
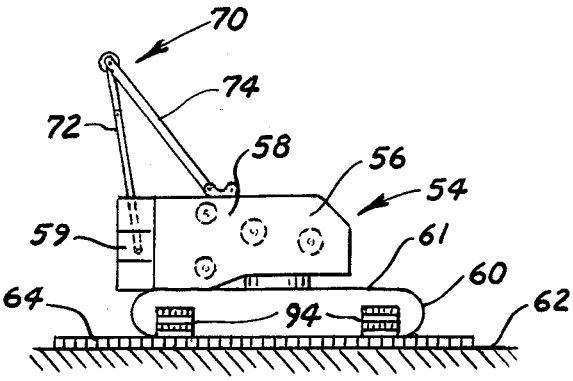
FIGS. 2, 4, 6, 8 are side elevational views of a machinery platform supporting a first counterweight, a carbody, a gantry assembly, and a pair of side frame traction modules of the crawler crane of FIG. 1 illustrating the further assembly of various elements therewith including a support ring, support ring locating struts and shear struts, an oak support mat and ring support blocking in the process of building up the structure of the crane of FIG. 1.
Figure 3:
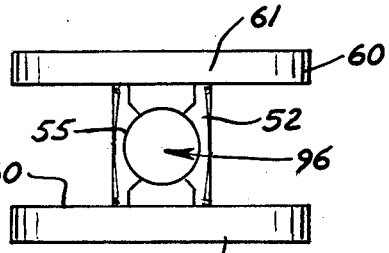
FIGS. 3, 5, 7 and 9 are top plan views of the crane elements as illustrated in FIGS. 2, 4, 6 and 8, respectively with the machinery platform removed for clarity of illustration.

Once the ground surface 62 has been prepared as set out above, and a sufficient support mat such as the oak timbers 64 have been put in place, the carbody 52 supporting machinery platform 54 on which is mounted gantry or A-frame assembly 70 is positioned as seen in FIGS. 2 and 3. Permanent blocking in the form of blocking stanchions 94 are set up to support a front segment of the support rings 214, in this case one of the three bottom fastening segments 218, at slightly below the final desired elevation.

Figure 4:
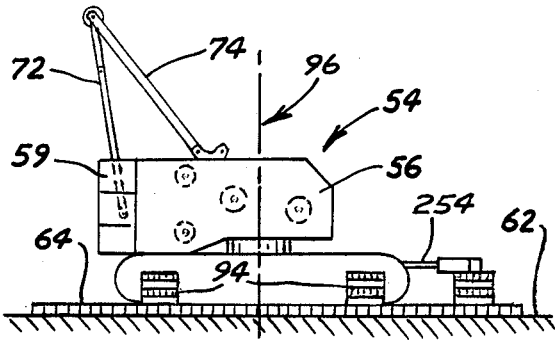

A rigid shear strut 256 is provided and is attached to the front of the carbody 52 and to the front ring segment 218. A pair of locating struts 254 are provided and are attached to fixed locations on the shear strut, immediately adjacent the carbody 52. Struts 254 are also attached to the ring segment 218 to positively locate that segment in concentric relationship with respect to the vertical axis 96 of machinery platform rotation. Using the shear strut as a guide, the center of the ring segment 218 is located on, or within one-half inch of, the longitudinal center line of the carbody and within one-quarter inch of the nominal predetermined radius of the continuous ring roller path 222. See FIGS. 4 and 5.

Figure 6:
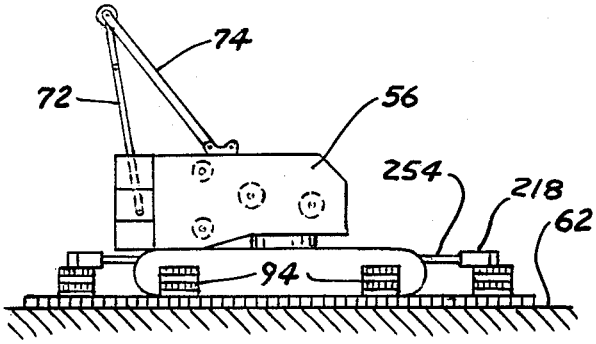
Figure 8:
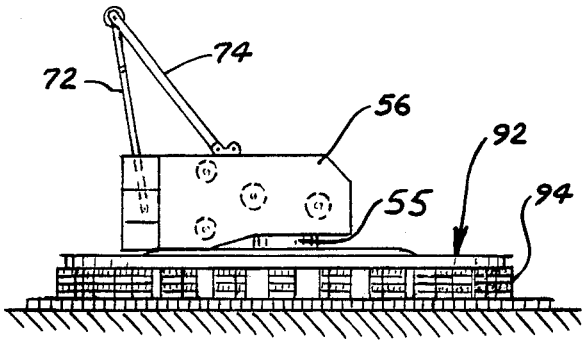
Figure 7:
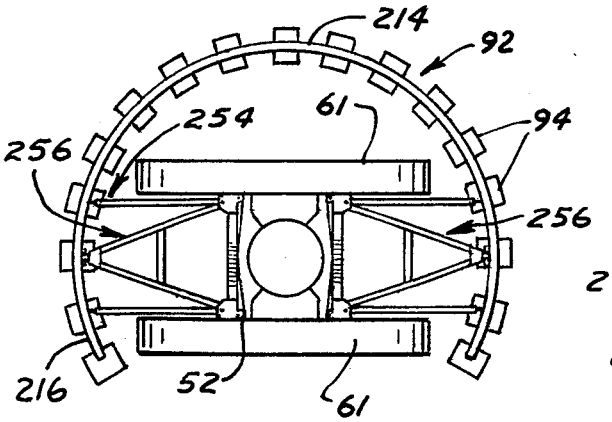
Figure 9:
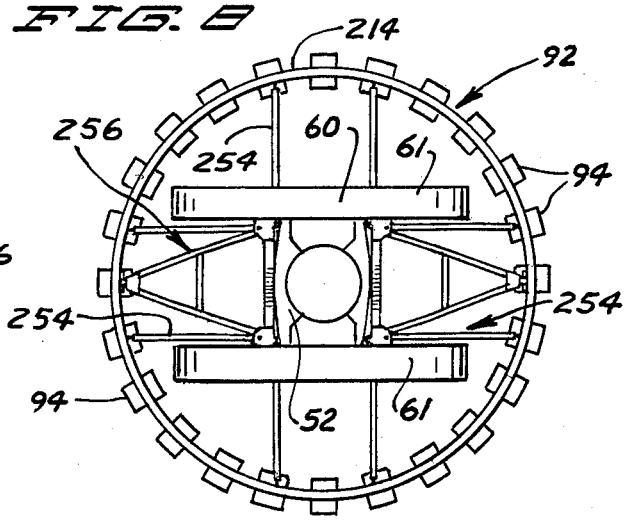

The rear segment, in this case one of the three top fastening segments 216, is similarly supported and located as are two left side segments (see FIGS. 6 and 7, and two right side segments (see FIGS. 8 and 9). Locating struts 254 and shear struts 256 are utilized to insure the exact positioning of the entire ring. Each segment, in turn, is spliced to its adjacent segments in the manner set out above in connection with FIGS. 40 through 45.

Details of the construction of the shear struts 256 and the locating struts 254 and details of the means for attaching these struts between the carbody 52 and the support ring assembly 92 are shown in FIGS. 48 through 51.

Figure 50:
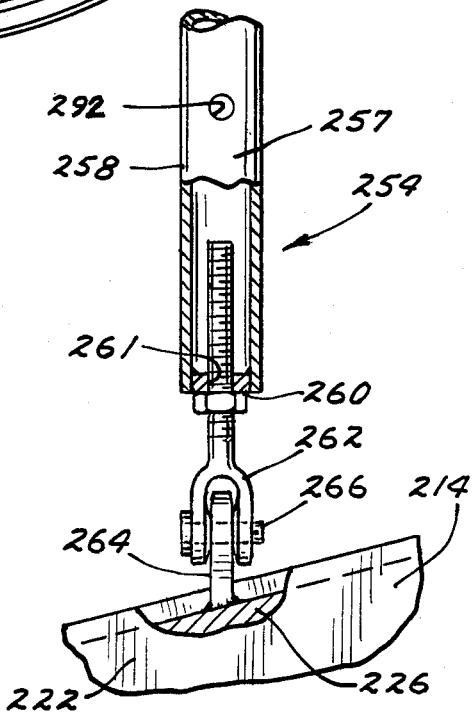
FIG. 50 is also a further enlarged fragmentary top plan view of a portion of the structure of FIG. 48 and showing the internal construction of a typical end of a typical locating strut and showing its connection to the support ring.

In all there are eight locating struts 254, and each includes a hollow tube 257 of structural steel having an outer end portion 258 and an inner end portion 259. A strut end plug 260 is permanently affixed in each end portion of each strut 254 and includes a threaded opening 261 to receive one of a pair of oppositely threaded turnbuckle yoke bolts 262,262. As seen in FIG. 50, the yoke of the bolt 262 is pinned to a locating strut attachment plate 264 which is integrally welded to and extends outwardly from the central web 226 of the support ring 214 through the instrumentality of a pin 266.

The four locating struts which extend transversely with respect to the longitudinal axes of the side frame traction modules 60,60 have identical structures, and the turnbuckle yoke bolts 262 at their inner end portions 259 are each similarly pinned to similar locating strut attachment plates extending outwardly from the main frame of these traction modules.

Figure 49:
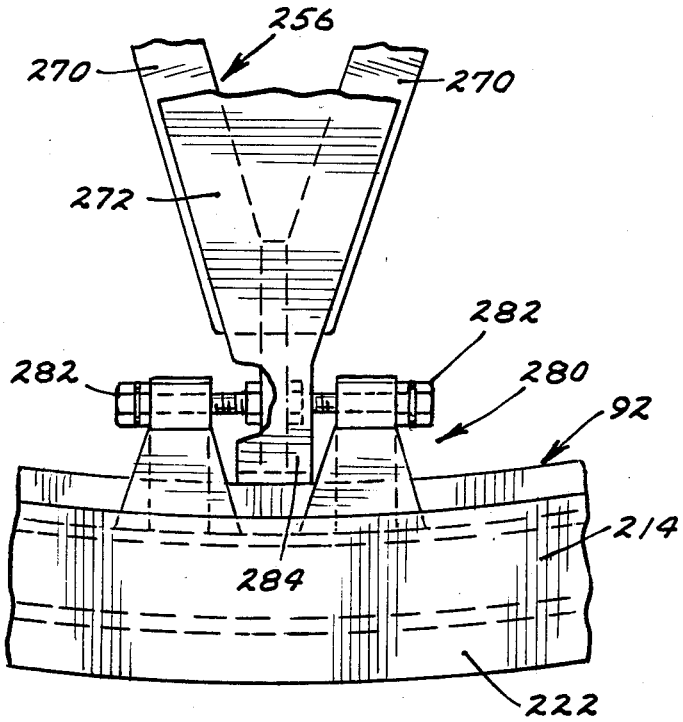
FIG. 49 is a further enlarged fragmentary top plan view of a portion of the structure of FIG. 48 and showing the details of the construction of one of the shear struts and its means for mounting on a segment of the support ring.

FIG. 49 illustrates the outer end connecting portion of a typical shear strut 256. This strut takes the form of a rigid isosceles triangle made of two converging strut legs 270,270, and a base leg 271 all welded to each other. These legs are reinforced by a pair of vertically aligned gusset plates 272 at the apex of the triangle and two pairs of vertically aligned gusset plates 274,274 reinforcing the connection of each strut leg 270 to the base leg 271.

Rearward outer edges of the base gusset plates 274,274 are provided with openings to receive pins 276 which positively fixedly position and fasten one of the shear struts 256 to a pair of shear strut connecting plates 278,278 extending integrally forwardly of the front end of the carbody 52.

At the precise center of the front ring segment 218, for example, a shear strut positioning bracket assembly 280 is positioned. This bracket is provided with positioning bolts 282,282 which are designed to be turned down to fixedly position a tongue 284 of the shear strut 256, the center of this tongue being in exact alignment with the axis of the carbody.

Figure 48:
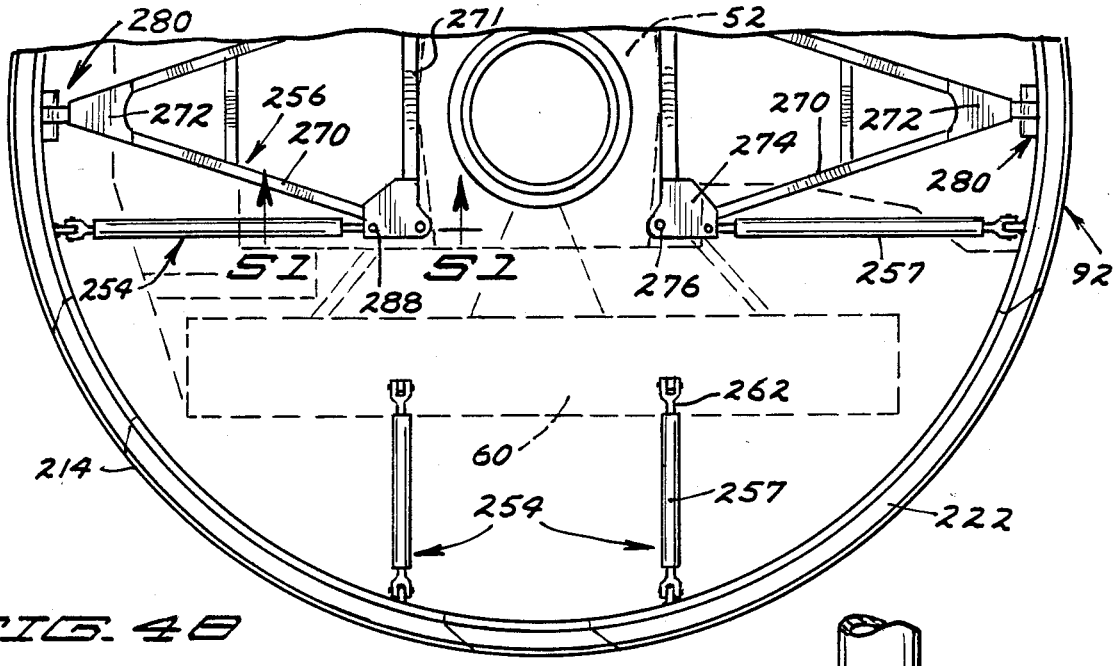
FIG. 48 is an enlarged fragmentary top plan view of the support ring, support ring locating struts and support ring shear struts as seen in FIG. 9 with the carbody and a side frame traction module shown in phantom.
Figure 51:
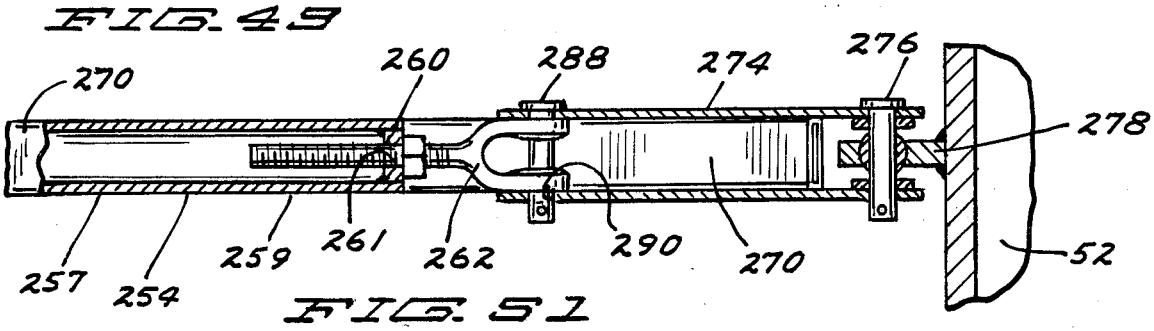
FIG. 51 is an enlarged fragmentary vertical sectional view taken on the line 51—51 in FIG. 48.

As best seen in FIGS. 48 and 51, inner end portions 259 of the four locating struts 254 which lie parallel to the longitudinal axis of the carbody 52 have exactly the same construction as do the outer end portions of the other four locating struts; but the yokes of the bolts 262 are held by positioning pins 288 in fixed relation to provided openings 290 in forward outer edges of gusset plates 274,274.

The complete blocking by blocking stanchions 94 is shown only in FIGS. 8 and 9; but it is to be realized that, where the context indicates, the four or so representations of blocking stanchions 94 in any other figure are symbolic and represent complete blocking under the support ring 214. Full blocking has been omitted for clarity of illustration.

Figure 10:
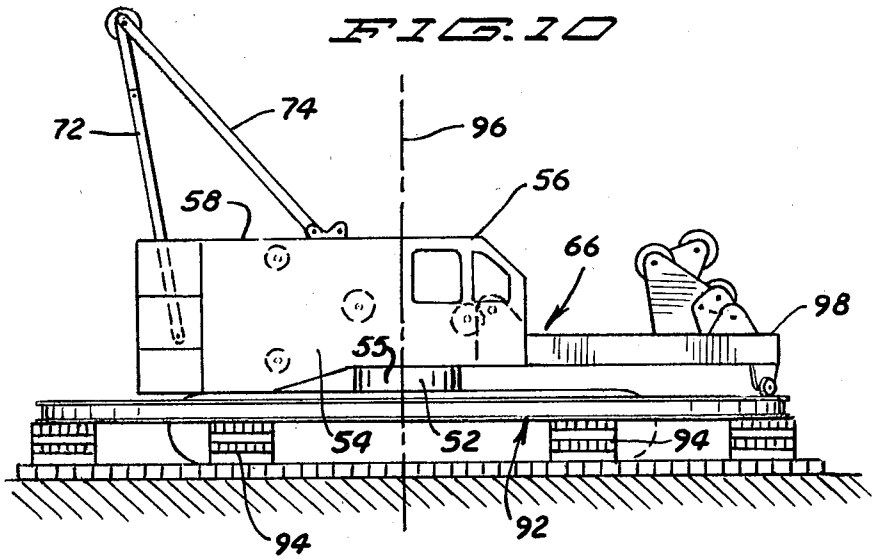
Figure 11:
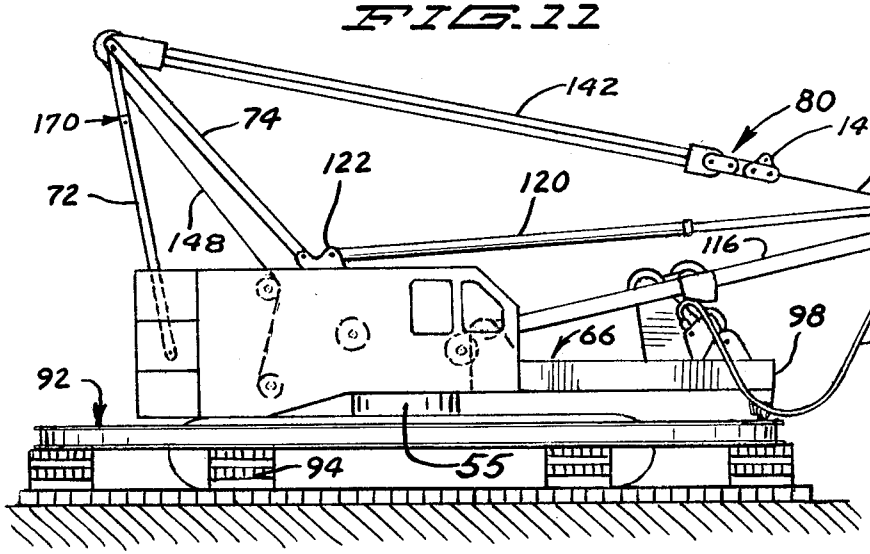

As seen in FIG. 10, the boom foot carrier assembly 66 will next be pinned in place in a manner and in a position as described above. At this point, the boom foot carrier retaining hook means such as hooks 188 on the one hand and hook roller support straps 202 and hook rollers 200 on the other will be left off. As seen in FIG. 11, the travel strut and mast erection assembly 68 will be installed with the extensible mast stops 120 in their extended position, with the travel or compression struts 116 lowered forwardly and resting on the boom foot carrier assembly, thus leaving the boom foot carrier tension pendants 126 to lie slack as seen in that figure. The carrier/mast luffing 142 will be attached between the top of the gantry 70 and the triangular carrier/mast suspension links 146. The boom foot carrier suspension pendants 140 will be installed between these suspension links 146 and the travel strut assembly links 124 of the travel strut and mast erection assembly 68.

Figure 12:
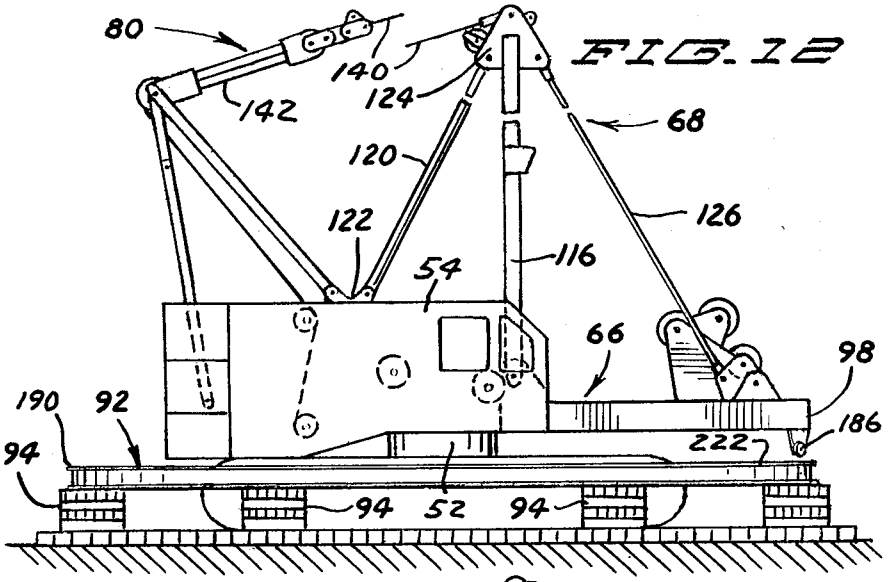
FIGS. 10 through 15 illustrate the progressive steps in adding a boom foot carrier assembly, a compression strut assembly, a boom foot carrier suspension assembly, a trailing counterweight assembly and a second counterweight to the structure of FIGS. 8 and 9.

Next, and as seen in FIG. 12, the travel strut assembly 68 will be raised by hoisting in on the carrier luffing 142 until the boom foot carrier tension pendants 126 are taut and then until the boom foot carrier support rollers 186 are raised about 6" off of the roller path 222. This position is used to check out the clearances between the various parts, and when these have been determined to be satisfactory, the carrier luffing will be let out to lower the boom foot carrier back onto the ring, where the boom foot carrier retaining hooks 188 will be installed.

Next, the machinery platform 54 will be swung 360° around the carbody 52 to check the clearance between the retaining hooks 188 and the upper ring flange 190 and to check the ring path location with respect to the track of the boom foot carrier support rollers 186. When ring location concentric with the vertical axis 96 of the machinery platform rotation has been achieved, the locating struts will be bottomed out or extended to finally fix the position of the ring.

The support ring assembly 92 will then be raised to the precisely desired elevation relative to the bull gear of the carbody/machinery platform combination. This is done by raising the ring using the boom foot carrier suspension assembly 80 to cause the travel strut and mast erection assembly 68 to raise the outer end of the boom foot carrier 98 and consequently that portion of the support ring assembly 92 in alignment with the boom foot carrier retaining hooks 188. The proper elevation of the support ring assembly 92 is achieved by driving wedges between the top of the blocking stanchions 94 and the bottom flange 224 of the support ring 214. Where hook rollers 200 are being used as disclosed in FIGS. 38 and 39, once the portion of the support ring assembly 92 has been raised by those rollers and fixed at the desired height, the machinery platform can be swung continuously around its circle, with additional wedges being driven as the desired vertical positioning is achieved. If boom foot carrier retaining hooks 188 are used, however, the machinery platform will have to swing around to one ring segment at a time and raise each segment, drive wedges, and then move to the next segment, raisingand driving wedges until the vertical positioning of the support ring assembly is achieved.

At the same time that exact vertical positioning of the support ring assembly is being achieved, the ring can be shifted as necessary using the locating struts to bring it into exactly concentric relation with respect to the vertical axis 96 of machinery platform rotation. This support ring positioning can be determined by observing the location of the rollers at they roll around the ring path. When the ring is centered, all of the locating struts 254 will be bottomed out (extended). This is accomplished by inserting turnbuckle turning bars (not shown) through provided openings 292 adjacent each end of each of the locating struts, and then, using these bars, rotating the tubes 257 to force each of the turnbuckle bolt yokes to move in direction away from its tube 257.

Figure 13:
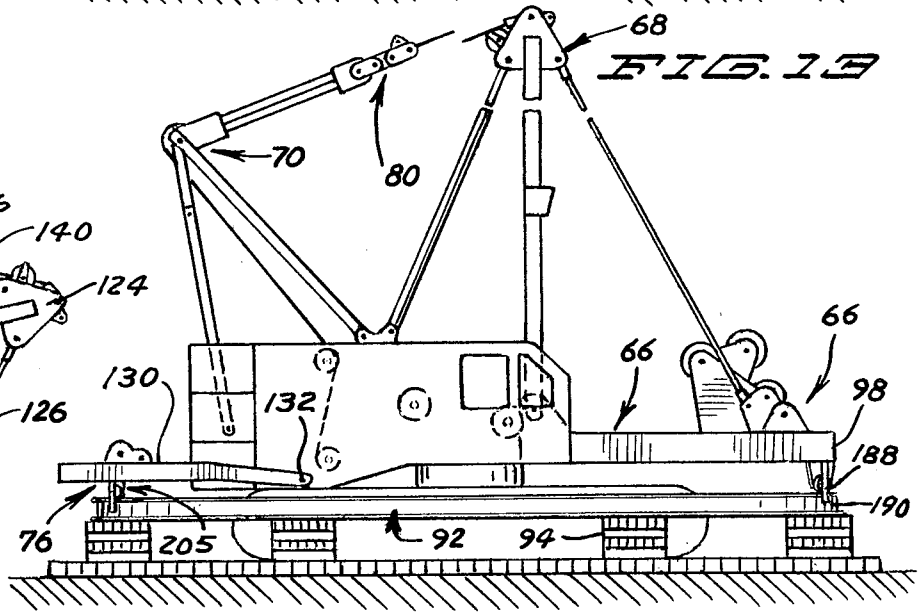

FIG. 13 illustrates the configuration of the boom foot carrier retaining hooks 188 as the aforementioned support ring leveling operation is performed; and also illustrates the next step of installing the trailing counterweight assembly 76 and the counterweight tray support assembly 205.

Figure 14:
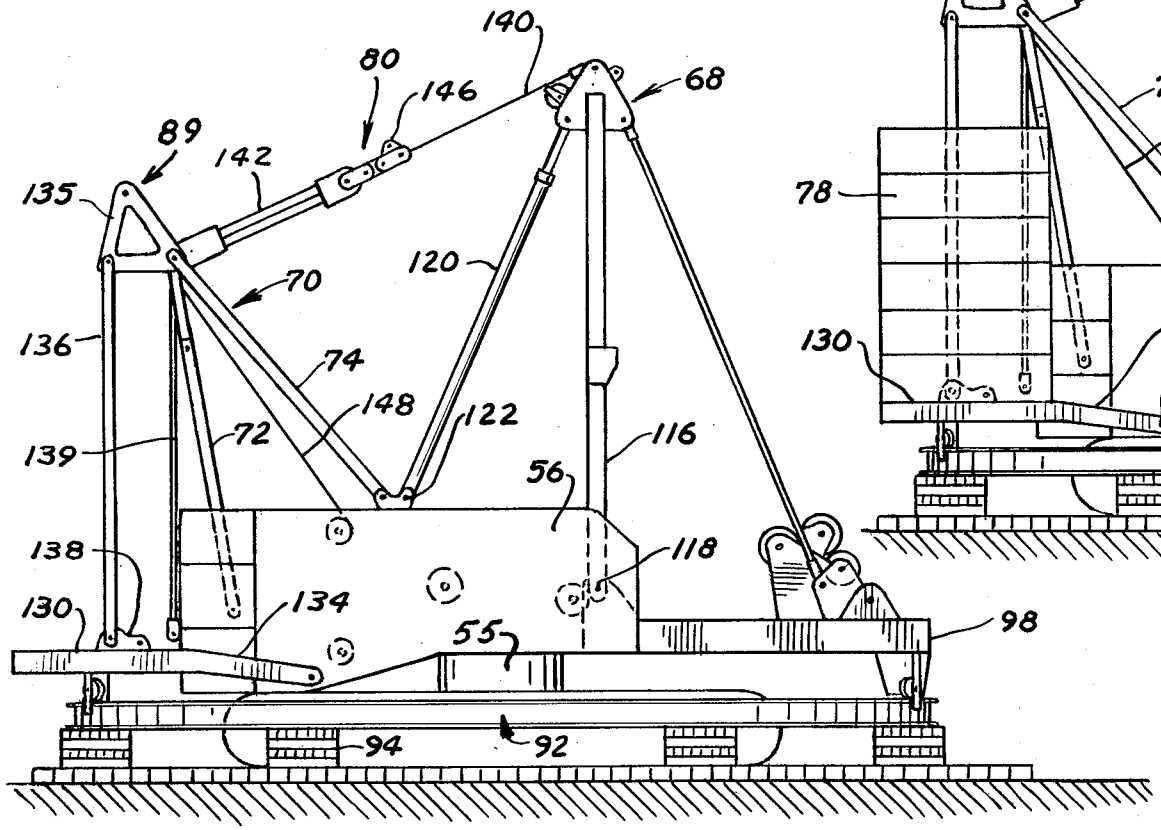

Next, and as seen in FIG. 14, the triangular suspension equalizer plates 135 are installed to have a lower forward corner pivoted to the gantry 70 and to an inner bail of the carrier/mast luffing 142. The trailing counterweight suspension links 136 are pinned to the lower rear corner of the suspension equalizer plates 135, and are pinned at their lowermost ends to the trailing counterweight suspension plates 138. Also, the trailing counterweight support travel pendants 139 are pinned to hang freely from the lower forward corner of the triangular suspension equalizer plates 135, the gantry 70 and inner bail 144 of the carrier/mast luffing 142.

Figure 15:
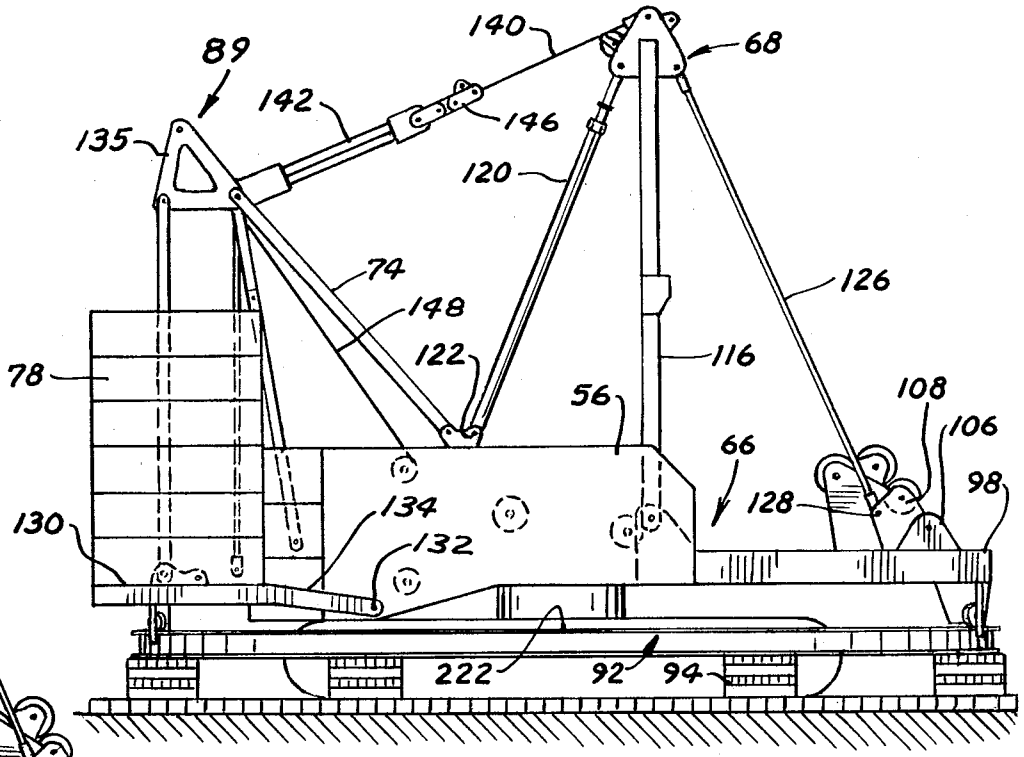

As seen in FIG. 15, the full second trailing counterweight 78 is added to the counterweight tray 130, the machinery platform is once again swung around the entire support ring assembly 92, and any changes caused in the leveling of the support ring assembly due to the full weight of the counterweight on the ring are overcome by once again leveling the ring as explained above.

Figure 16:
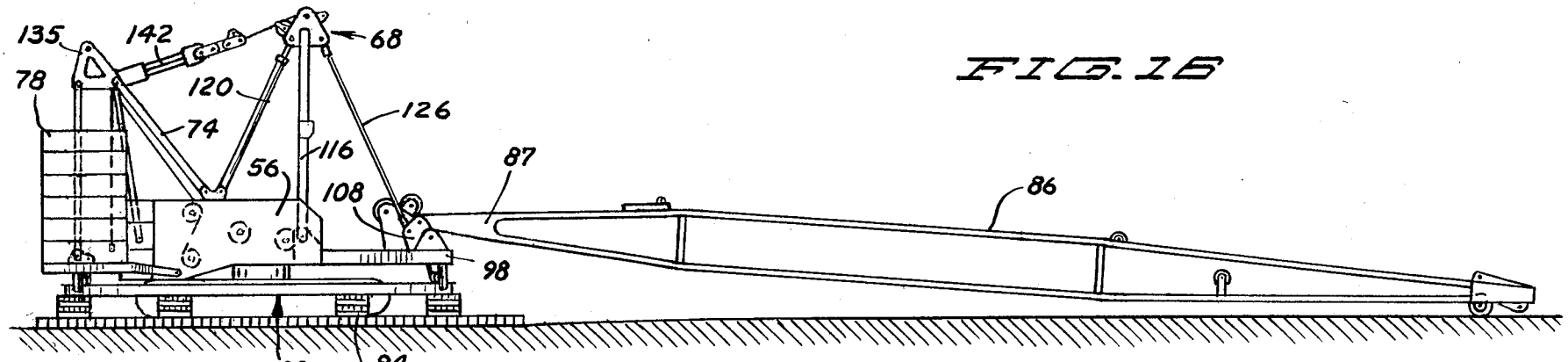
FIGS. 16 through 25 are side elevational views illustrating the erection of the mast and boom.
Figure 17:
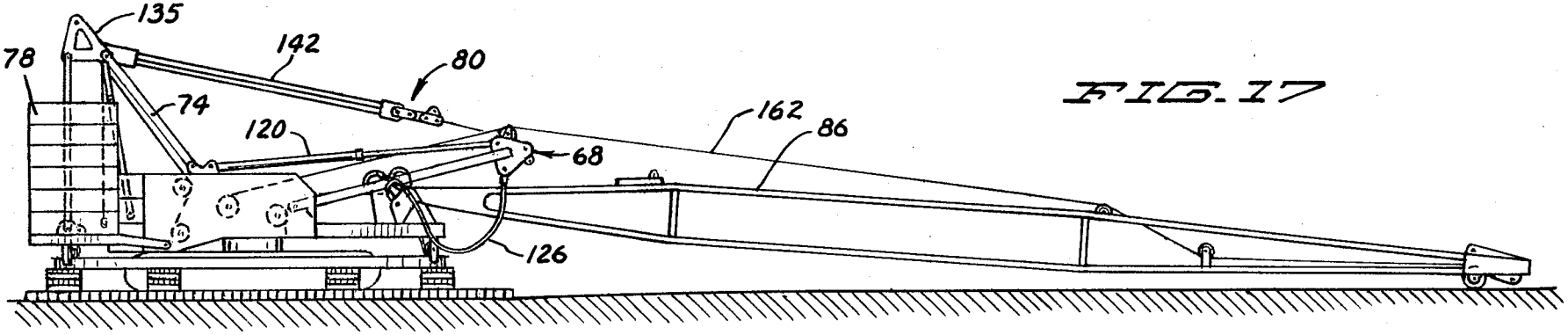

As seen in FIG. 16, the mast 86 is assembled and the mast foot 87 is mounted in the mast foot mounting pivot plates 108,108 in the manner as described above. Next the travel strut and mast erection assembly 68 is lowered to position as seen in FIG. 17, and first boom suspension luffing line 162 is reaved through the mast to the mast point.

Figure 18:
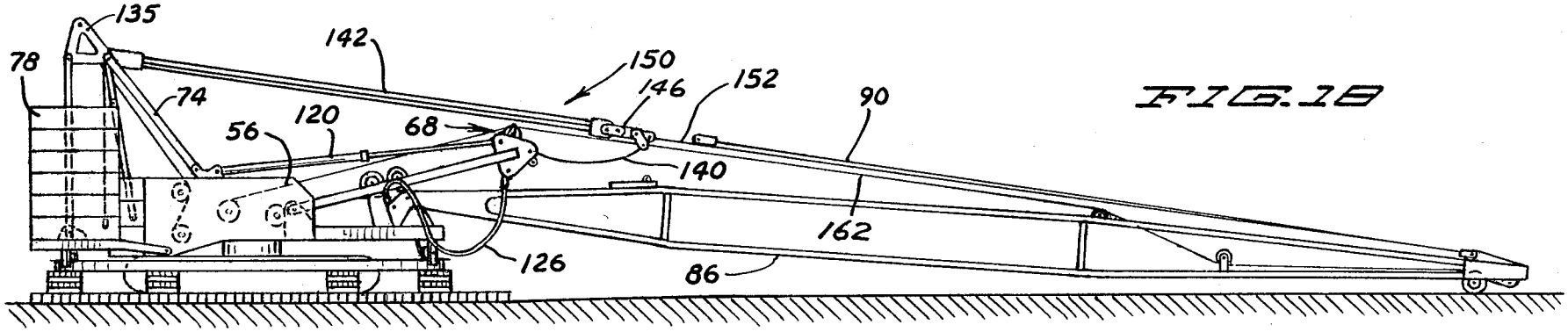

As seen in FIG. 18, the mast suspension assembly is completed, including attaching the mast suspension pendants 152,152 to the triangular carrier/mast suspension links 146 and to the point of the mast 86. Second boom suspension linkage or counterweight carrier suspension pendant means 90 are installed.

Figures 19, 19A, 20, 21:
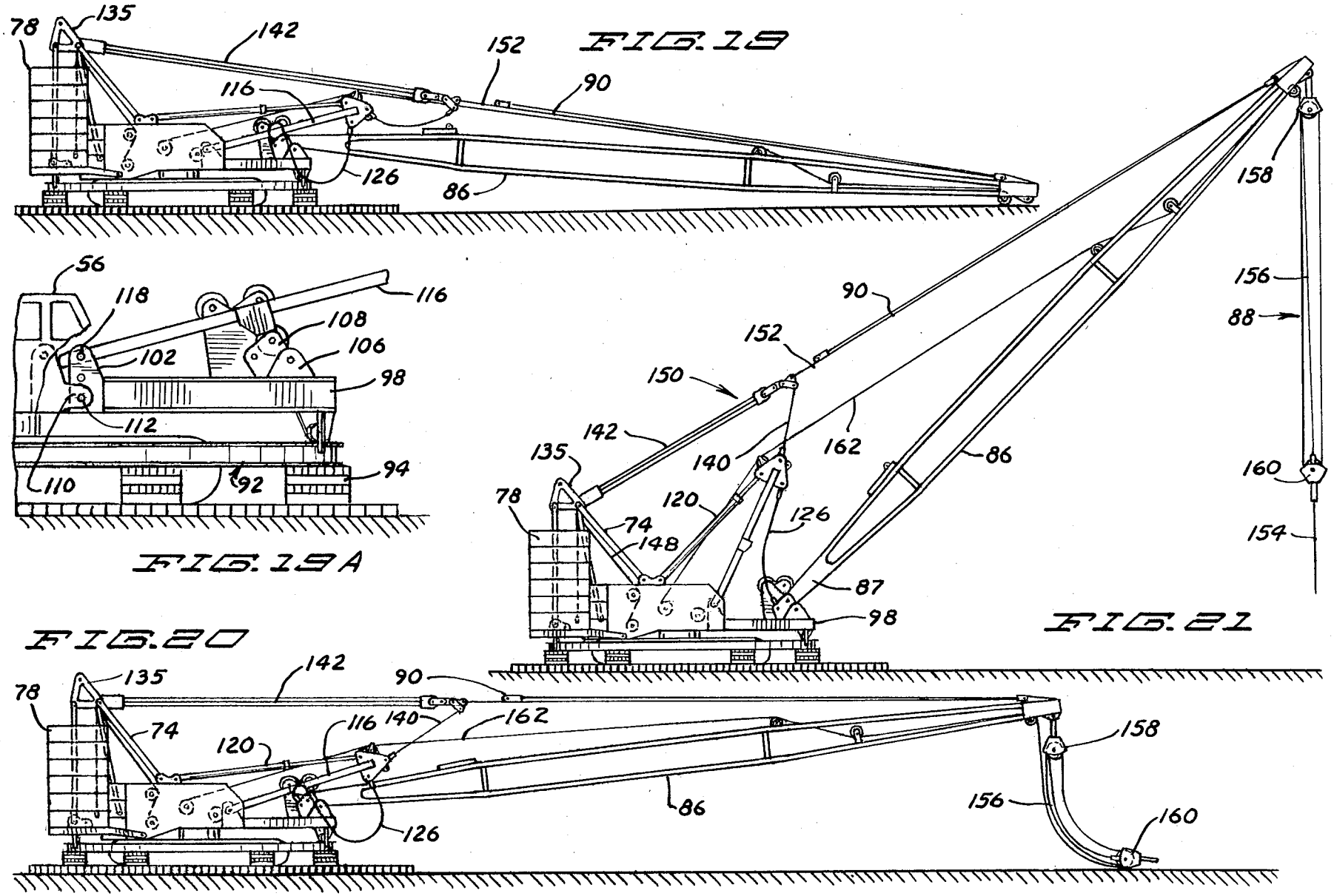

As seen in FIGS. 19 and 19A, mast luffing 142 is hoisted in to put tension on the mast suspension assembly 150. At this point, the relationship of the foot of the travel or compression strut 116 with respect to the original crane mast/boom foot receiving plates 110 is checked to insure that these two are in interfering relationship with respect to each other to stabilize the boom foot carrier at mast erection. See also FIG. 35.

As seen in FIG. 20, mast luffing 142 will be shortened to raise the mast to the point where boom foot carrier suspension pendants 140 are under tension and are straight. From this point on, the boom foot suspension assembly 80 and the travel strut and mast erection assembly 68 will be erected along with the mast. The boom suspension luffing outer bail 160 must be reaved out far enough out so that the outer bail won't lift off of the ground until the mast is at an angle of 30°.

As seen in FIG. 21, the mast can be raised to an angle between 30° and 82° and can then be used as a boom. Using the first boom suspension linkage 88 with the mast at 30° or higher, a load can be picked up to check out the movement of the travel strut and mast erection assembly 68 and the mast suspension assembly 150.

Figure 22:
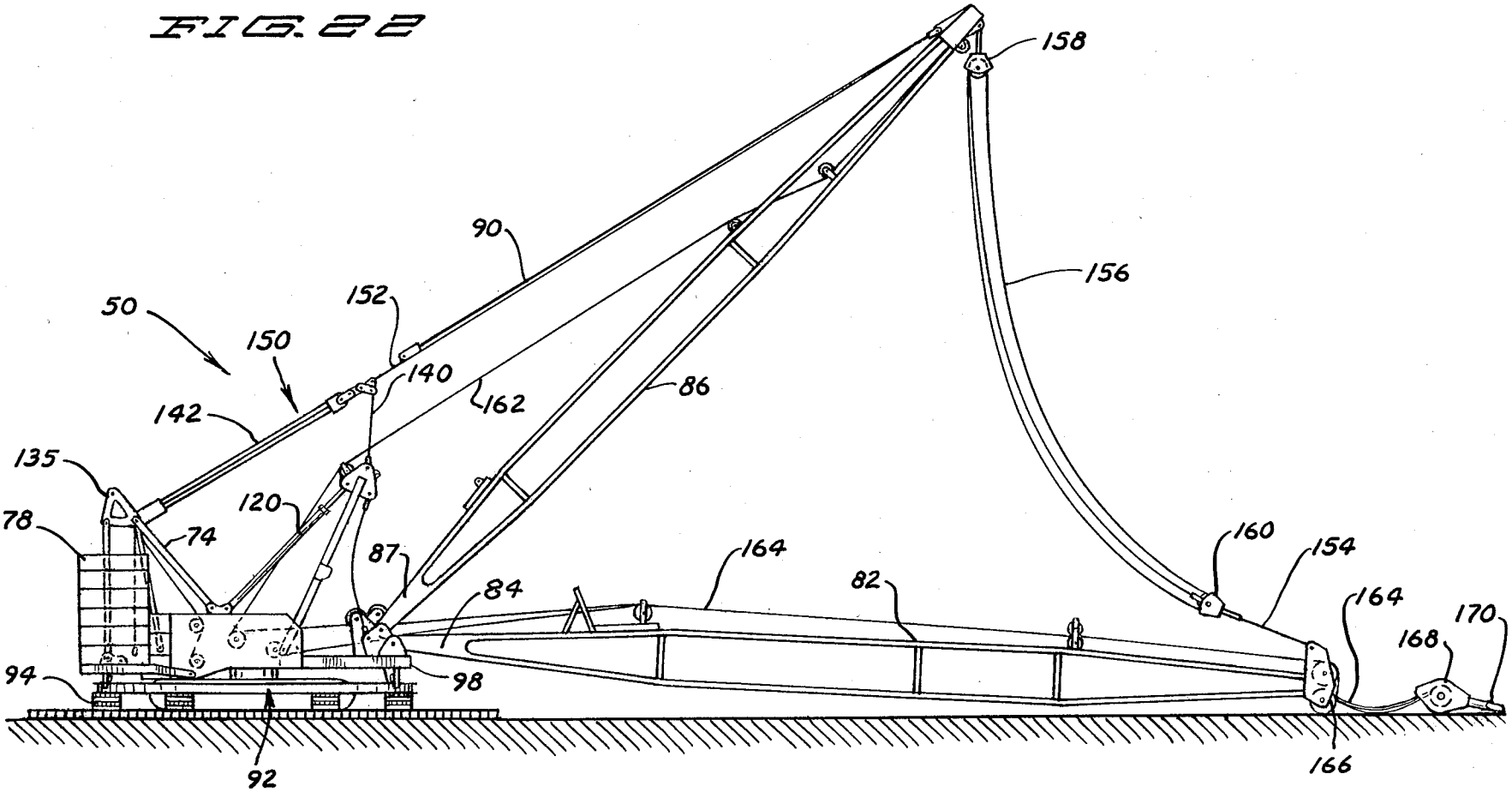

As seen in FIG. 22, the boom is assembled and boom foot 84 is mounted in boom foot mounting pivot plates 106 of the boom foot carrier 98. First boom suspension pendants 154 which are attached to the outer bail 160 of the boom suspension luffing are then attached to the boom point. The load handling line 64 is reaved through the boom, boom point block 166, and load block 168.

Figure 23:
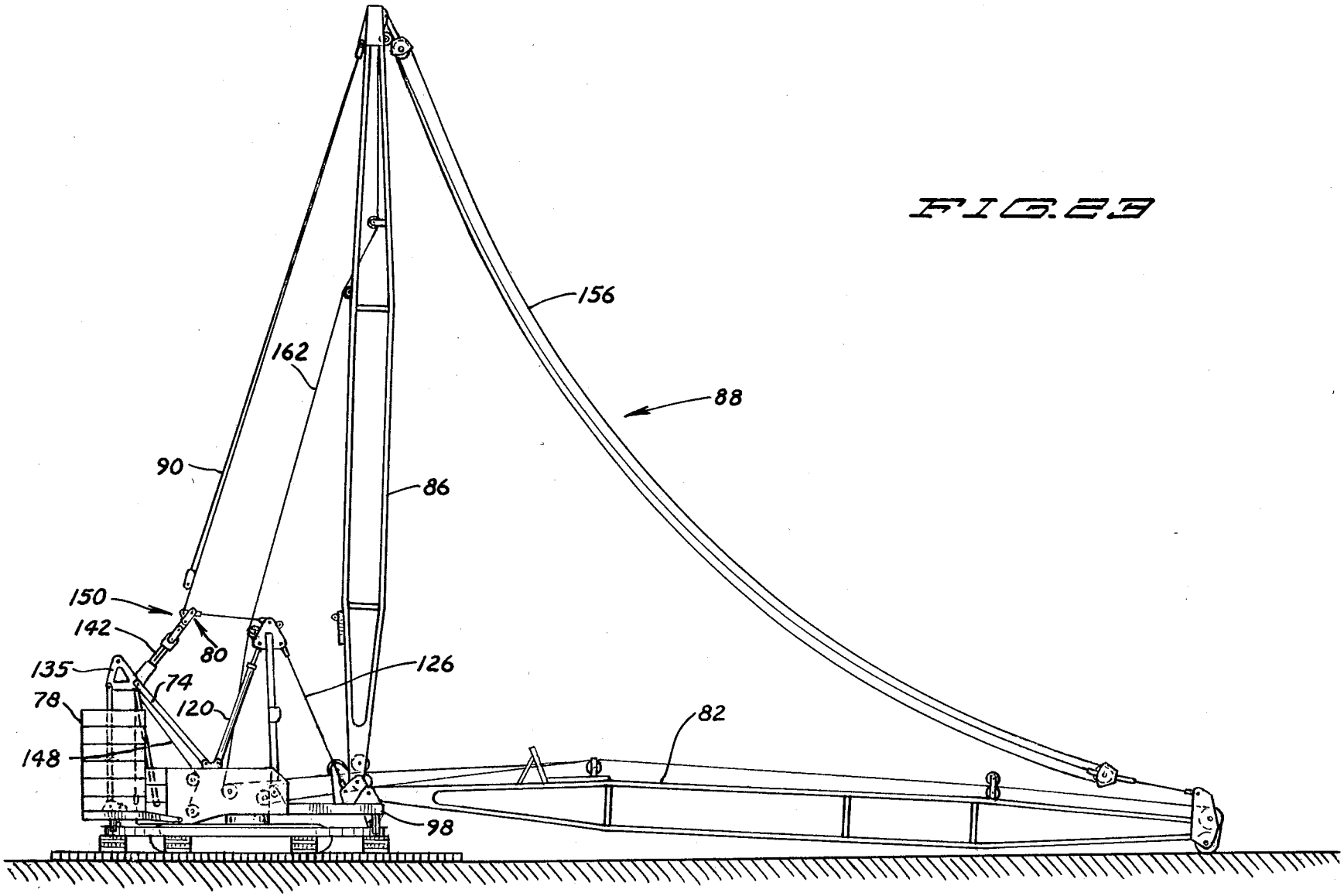
Figure 24:
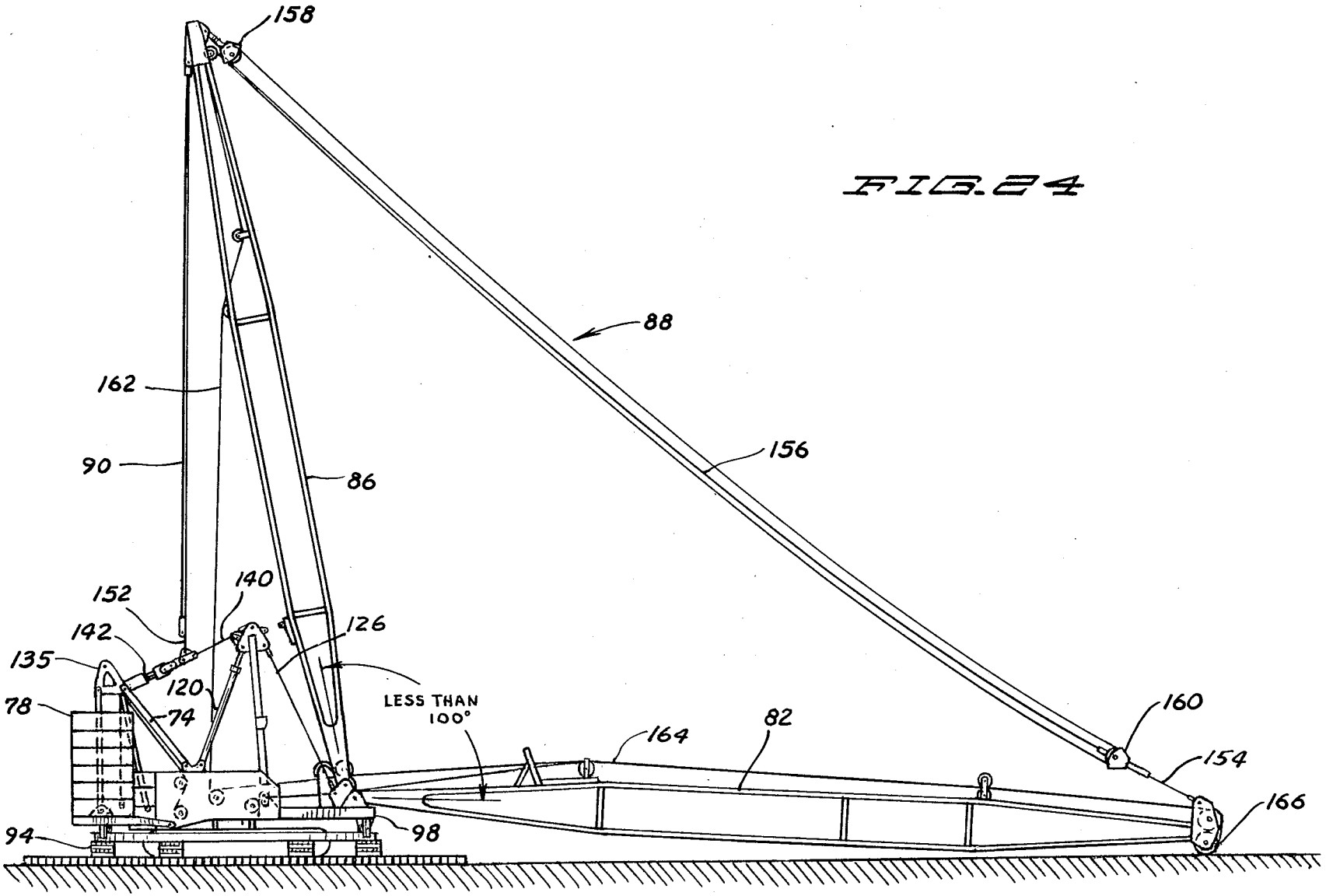

As seen in FIG. 23, the mast is raised to approximately vertical position by hoisting on the carrier/mast luffing line 148 and by paying out on boom suspension line 162. Next, the mast is pulled over backward until the boom foot carrier suspension pendants 140 are just about in line with the mast luffing 142. See FIG. 24. At this point, the mast luffing 142 becomes the boom foot carrier luffing 142. The carrier/mast luffing 142 is used to pull the mast back no greater than 100° with respect to the forward horizontal. Further tension on this luffing 142 would tend to cause boom foot carrier tension pendants 126 to lift the forward portion of the boom foot carrier. The slack in first boom foot suspension linkage 88 is controlled through the first boom suspension luffing line 162 so that the mast 86 will not fall back uncontrolled. See FIG. 24.

Figure 25:
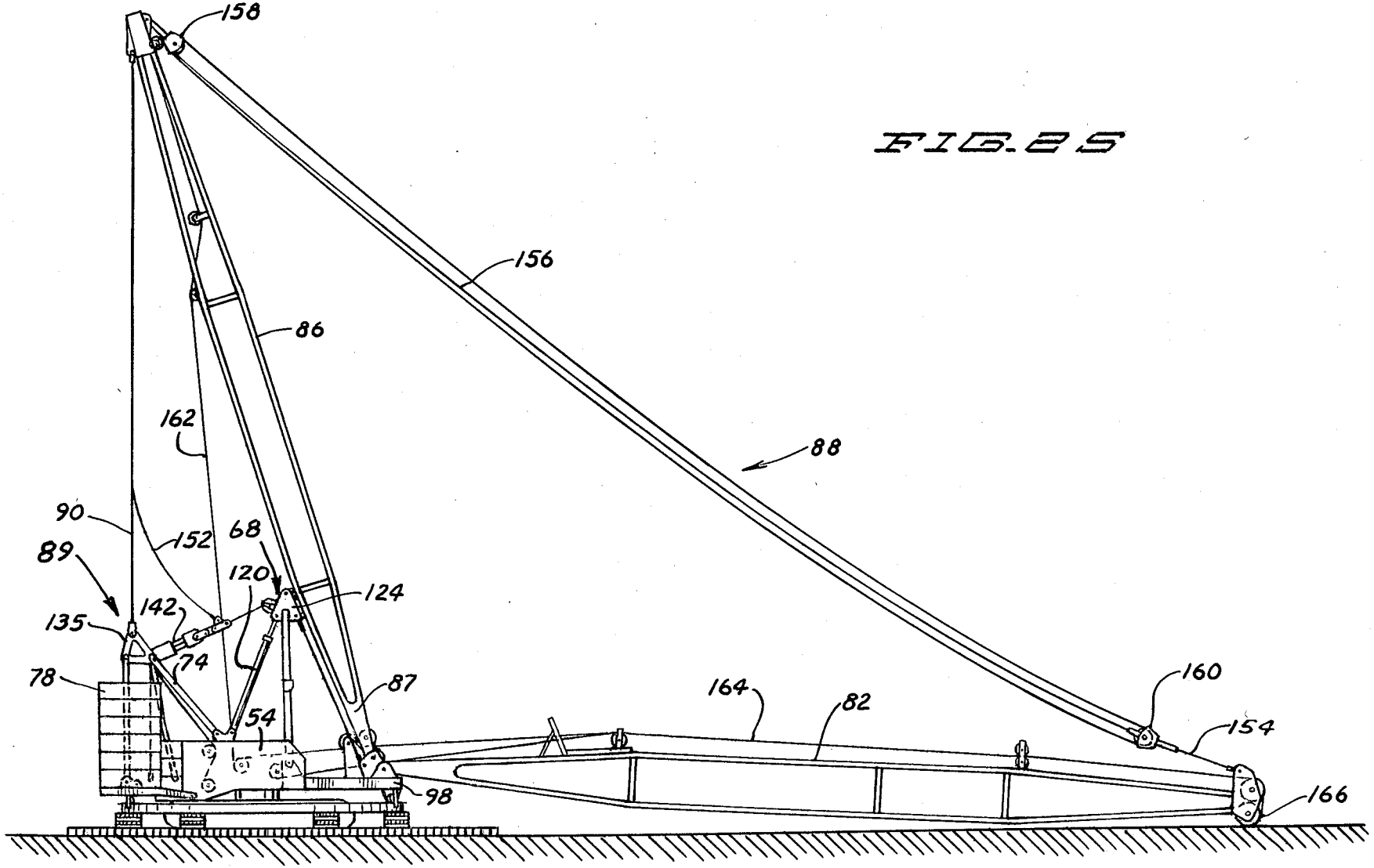
Figure 9I:
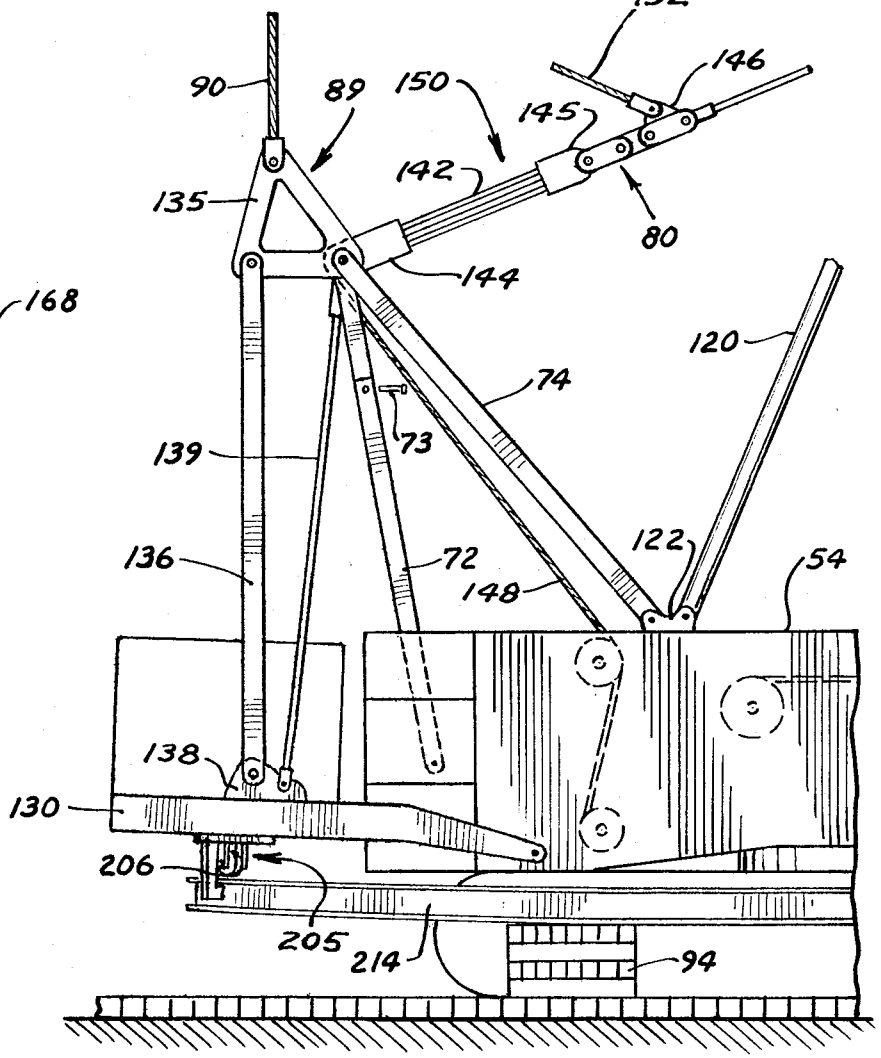
Figure 9B:
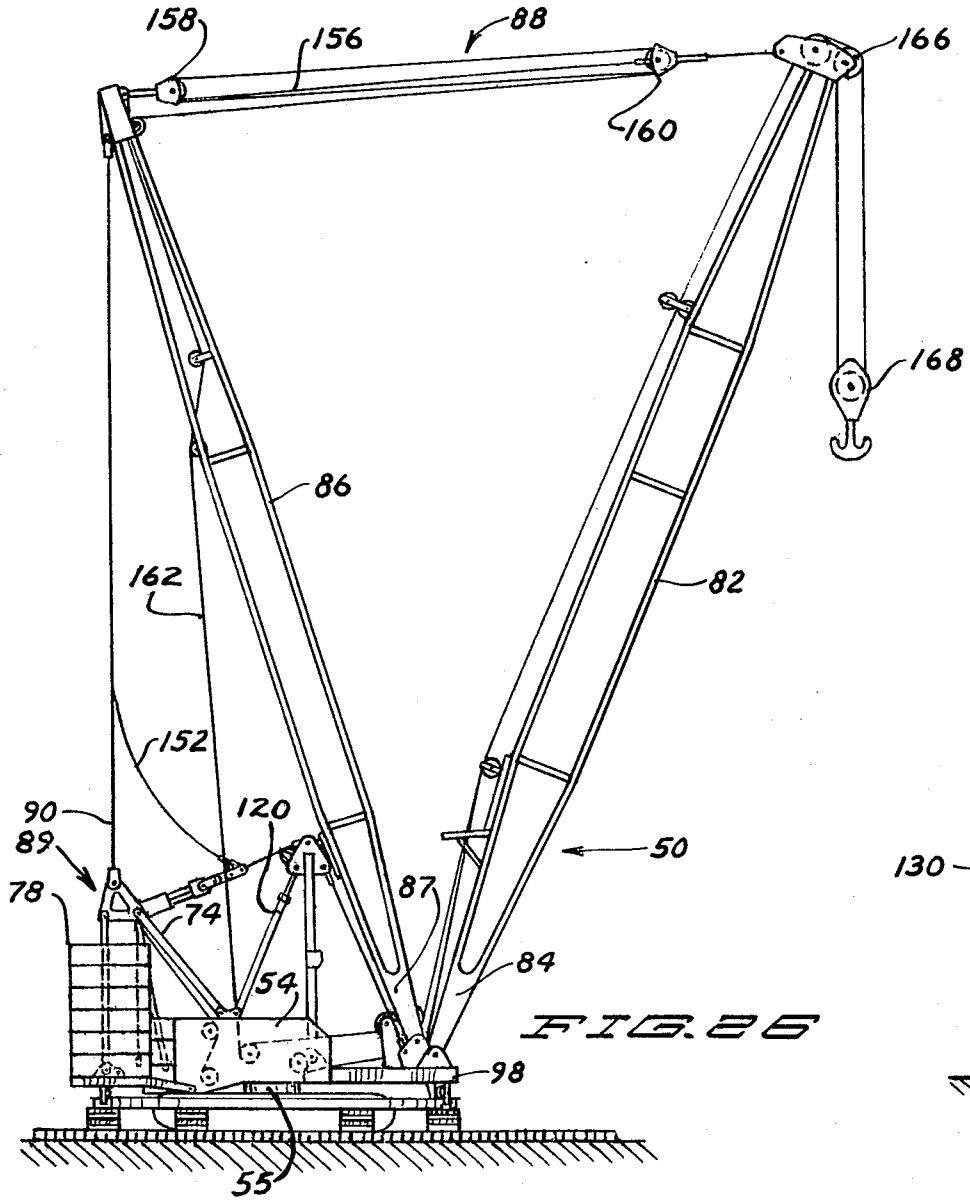

Once the position of 100° from forward horizontal is reached, the first boom suspension luffing line 162 will be paid out to lengthen the boom suspension luffing 156 to allow the mast to fall back on its own to the travel strut and mast erection assembly 68. When this point is reached as seen in FIG. 25, the second boom suspension linkage or counterweight carrier suspension pendants 90 is attached to the top of the triangular suspension equalizer plates 135. The boom foot carrier luffing 142 will be slacked off. The length of the mast suspension pendants 152 and of the counterweight carrier suspension pendants 90 is such that the mast suspension pendants 152 will be slack as seen in FIG. 25 as long as the counterweight carrier suspension pendants 90 are connected to the triangular suspension equalizer plates 135.

As seen in FIG. 26, the crawler crane 50 is put into its normal operating and working configuration by hoisting in on first boom suspension luffing line 162 to shorten the boom suspension luffing 156 and thereby position the boom at a desired working angle. In this configuration, the crane can be used to engage an operating load on its load hook 170, to lift such load by hoisting in on load handling line 164, to swing the load, to boom up or boom down to position the load directly over the point where it is needed and to lower it again by paying out on load line 164.

The connection of the second boom suspension linkage 90 to the triangular suspension equalizer plates 135 and the connection of plates 135 to the first counterweight 59 through rigid gantry backleg 72 and to the second trailing counterweight 78 through the trailing counterweight suspension links 136, causes both counterweights to share in resisting the overturning moment forces on the first and second boom suspension linkages 88 and 90 as various loads are hoisted on the load hook 170. The operating ratings of the crane are such that the reactive weight of the first and second counterweights in anchoring the second boom suspension linkage 90 is always at least 15% greater than the weight needed to maintain the boom 82 and any load on the load hook 170 in suspension.

Thus with the crane in the configuration seen in FIGS. 1 and 26, and even when handling a full workload, the counterweight support rollers 206 will always be carrying an appreciable portion of the weight of the counterweight 78.

As clearly seen in FIGS. 10 and 34 and similar figures, but as perhaps best understood from FIG. 26, the boom foot mounting pivot plates 106 and the mast foot mounting pivot plates 108 are not positioned at the far front end of the boom foot carrier 98, but are positioned at a forward end portion thereof. Therefore, the boom foot 84 and mast foot 87 are supported at position somewhat rearward of the boom foot carrier support rollers 186. This causes a small proportion of the weight of the boom and mast and the same proportion of the load generated forces on those members to be carried back through the inner end of the boom foot carrier to the machinery platform. The positioning of the boom foot mounting pivot plates, for example, along the boom foot carrier will determine the proportion of the boom loading which is carried by the machinery platform. To the extent the machinery platform, bull gear roller path and carbody have the strength to share some of the boom loading, this permits lightening of the ground loading directly under the boom foot carrier support rollers and allows the crane 50 to be used successfully over softer ground. This is especially important in the case of a crane designed to move to and from spaced apart locations on the same job site.

A typical design might be such that approximately one tenth of the boom loading was transmitted through boom foot carrier pivot pins 112 to the machinery platform. Where minimizing ground pressure is not a factor, however, the boom foot and mast foot can be carried out toward or at the front end of the boom foot carrier.

RIGGING FOR TRAVEL AND TRAVELING

Figure 28:
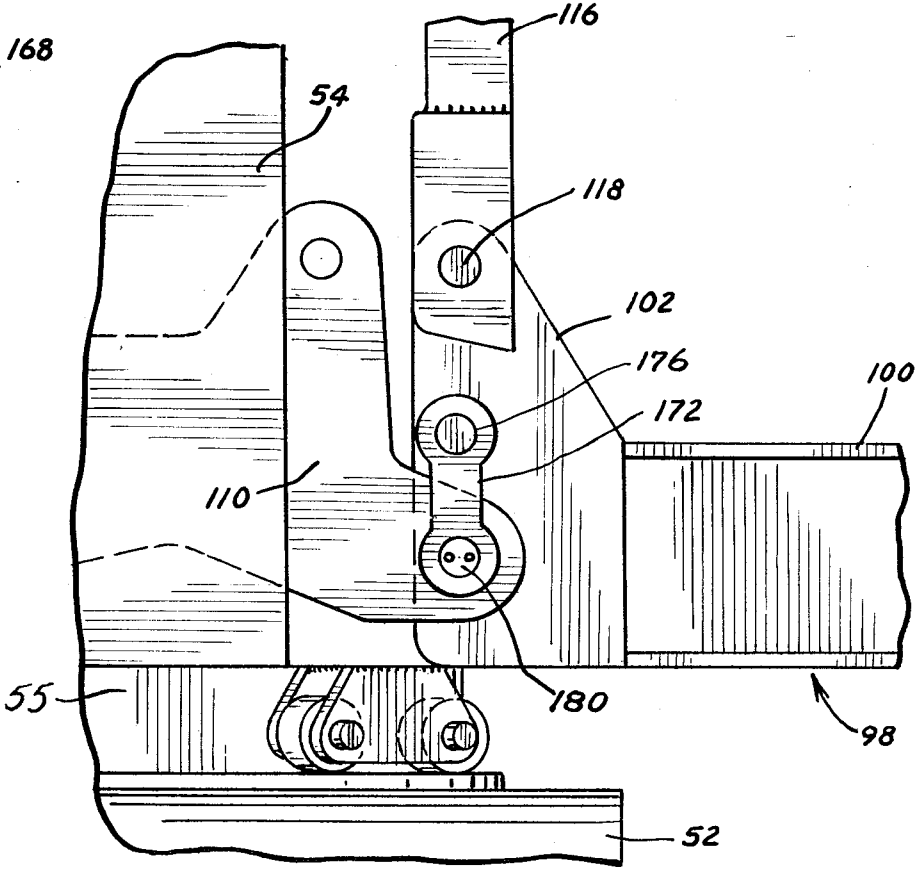
FIG. 28 is an enlarged fragmentary detailed sectional view with an operator's cab removed and showing the details of the connection of the boom foot carrier to the machinery platform, the connection of a compression strut to the boom foot carrier, and the positioning of lock-up links and pins for temporarily preventing the carrier from pivoting about its longitudinal axis during forward and rearward travel with the support ring.
Figure 27:
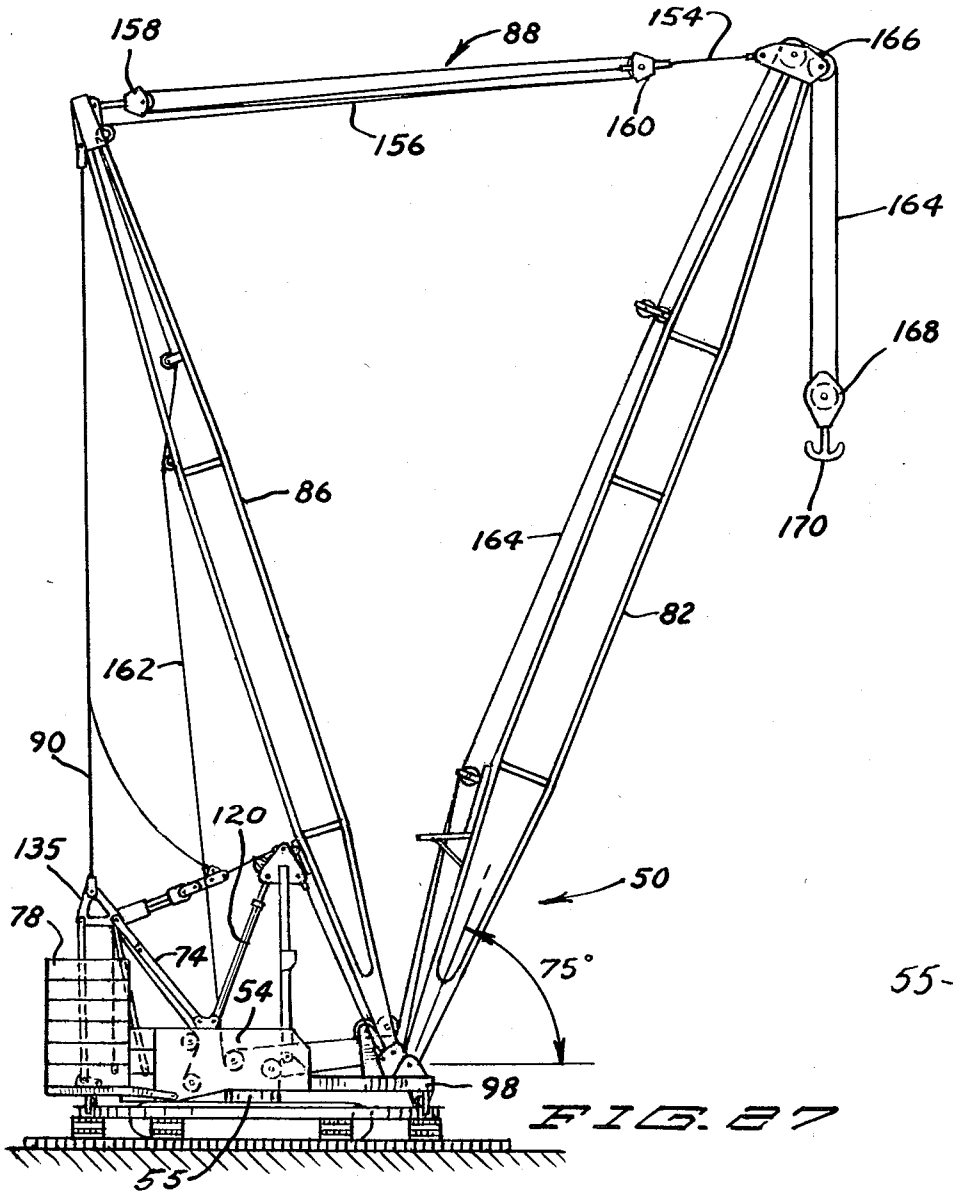
FIG. 27 illustrates the first step in rigging the crane for travel.
Figure 9D:
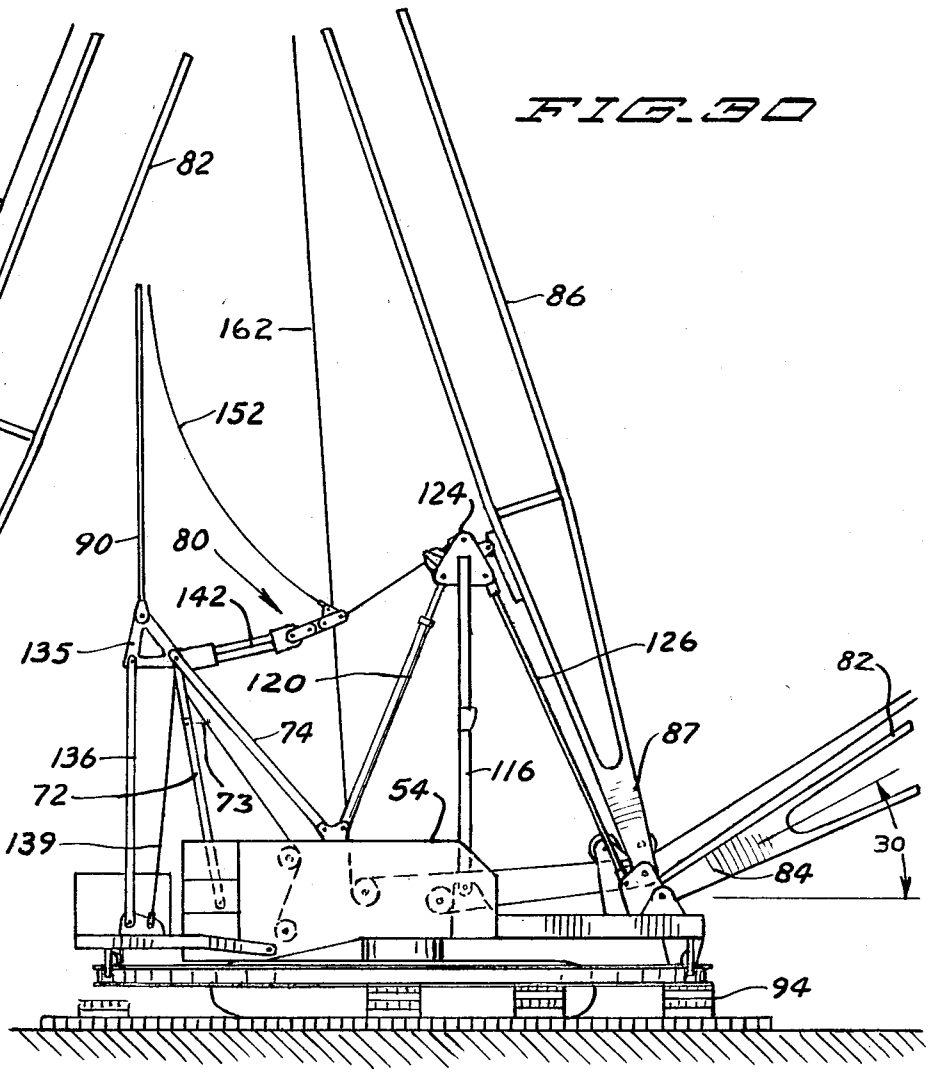
Figure 9B:
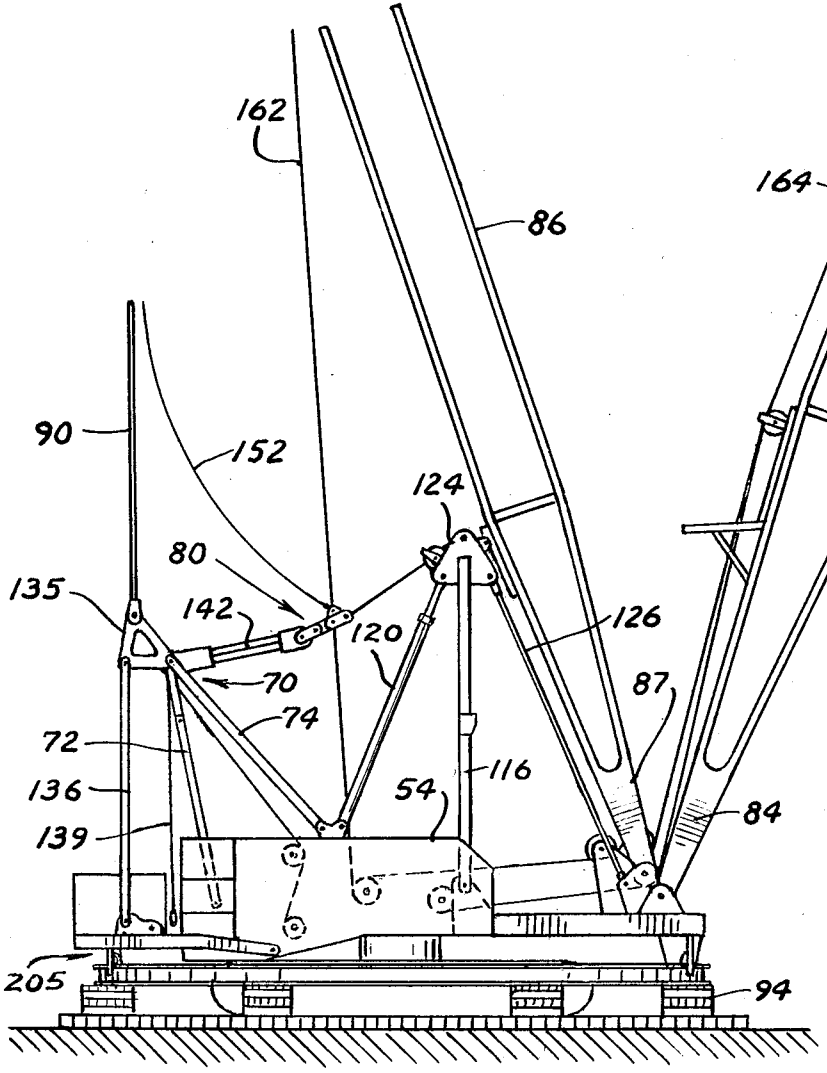
Figure 9A:
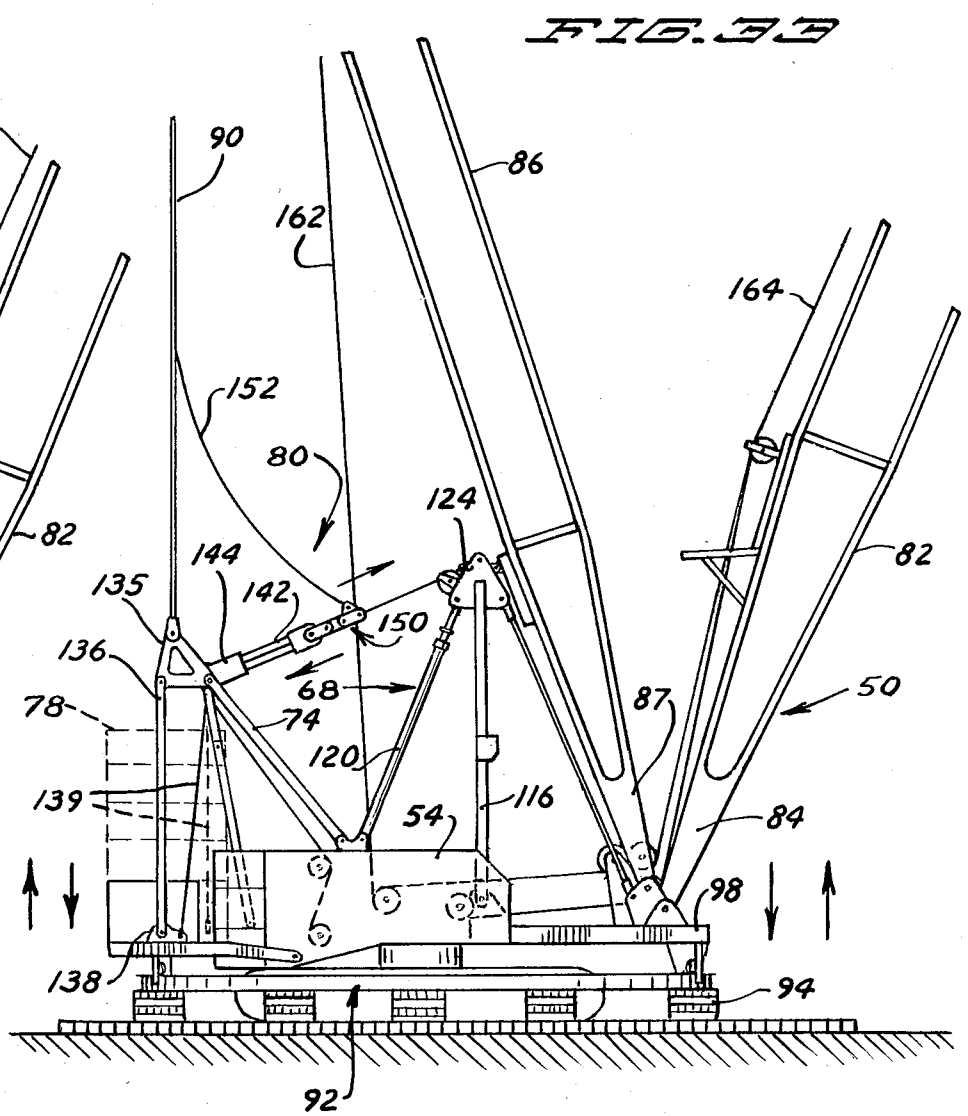
Figure 9B:
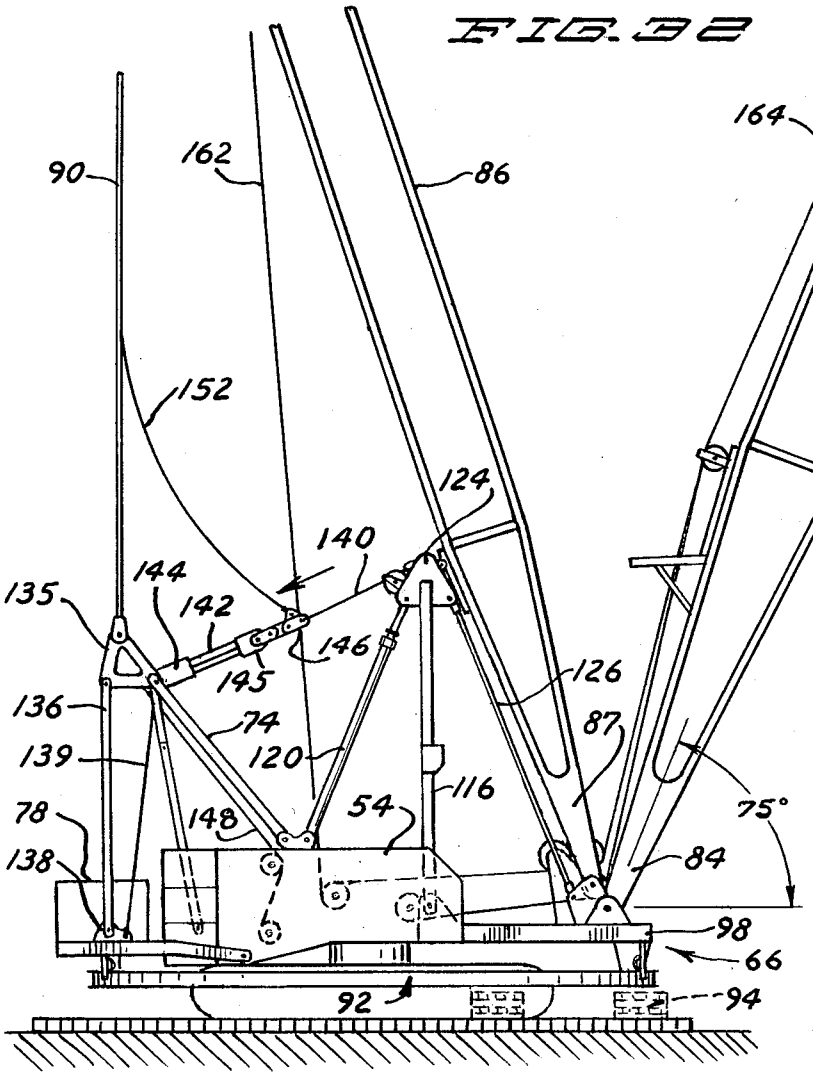
Figure 40:
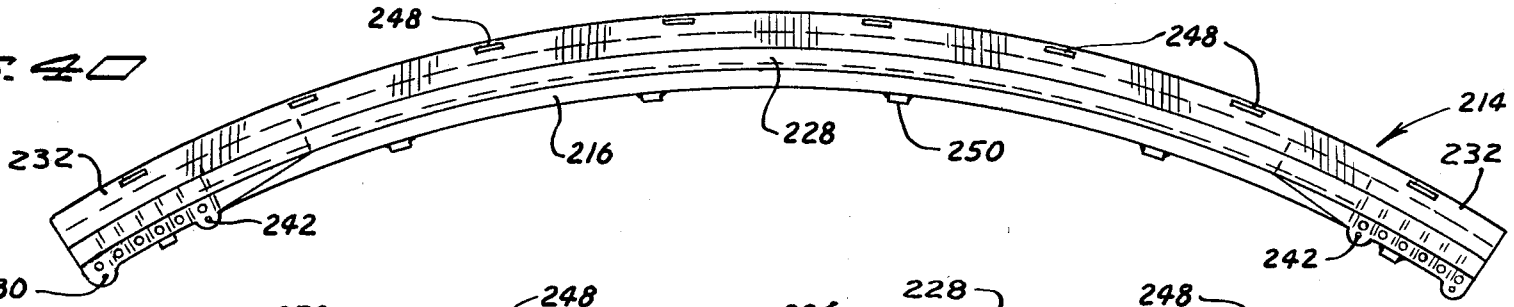
FIG. 40 is a top plan view of one of three top fastening segments of a six segment support ring of the invention.
Figure 41:
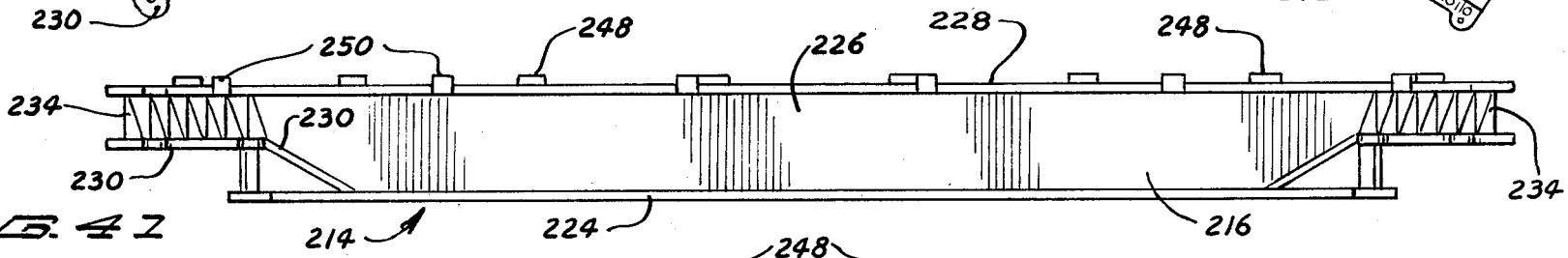
FIG. 41 is an interior side elevational view of the top fastening segment of FIG. 40.
Figure 42:
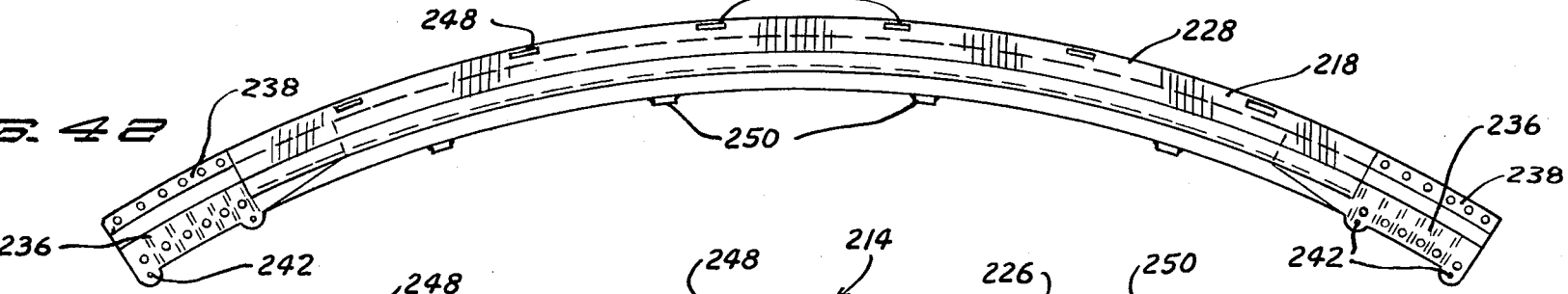
FIG. 42 is a top plan view of one of the remaining three bottom fastening segments of the support ring.
Figure 43:
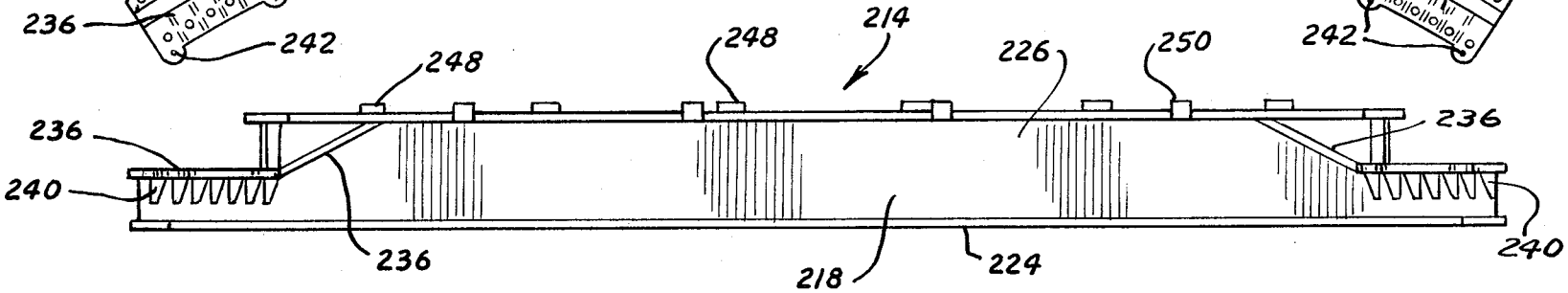
FIG. 43 is an interior side elevational view of the ring segment of FIG. 42.

Starting from the working configurations as seen in FIGS. 1 and 26, the boom will be inclined at an angle of approximately 75° with respect to a forwardly extending horizontal plane (see FIG. 27) and boom foot carrier lock-up pins 176 will be inserted through upper openings in lock-up links 172 and through lock-up pin receiving openings 174 in each inner end carrier pivot plate 102 (see FIGS. 28 and 36). As perhaps best understood from FIG. 36, the needed wobble about centerline 217 of the boom foot carrier assembly 66 (FIG. 34 and FIG. 37) which is advantageous when the crane is swinging in operating, working configuration, is entirely eliminated when lock-up pins 176 are inserted through the upper ends of lock-up links 172 and through openings 174 in inner end carrier pivot plates 102. Without the pins 176 in place, the boom foot carrier 98 can twist or wobble about the centerline axis 217 as its boom foot carrier support rollers 186 move over any deviation from the horizontal of the upper surfaces of ring cover plates 220 which form the continuous ring roller path 222. This is possible because of the elongated nature of the openings 171 in carrier pivot plates 102 which allow limited vertical movement of the inner end boom foot carrier pivot plates 102 with respect to so-called boom foot receiving plates 110 and boom foot carrier pivot pins 112. Lock-up links 172,172, however, are provided with cylindrical lower openings therethrough which fit snugly on the reduced diameter portions of boom foot carrier pivot pins 112, and the upper openings provided through those links 182 are also cylindrical and lock-up pins 176 fit snugly in them as well as fitting snugly in the openings 174 in the inner end carrier pivot plates 102. Thus there can be no more relatively vertical movement between the boom foot carrier 98 and its inner end carrier pivot plates 102,102 on the one hand and the so-called boom foot receiving plates 110,110 which are fixedly mounted as part of the machinery platform 54. This is so because the pins 112 each fit snugly in provided openings through each of the original or so-called boom foot receiving plates 110,110.

To lighten the load on the track shoes 61 while traveling over possibly uncompacted ground, and to lighten the load on the traction modules 60, carbody 52 and machinery platform 54, all of the weights which make up the second trailing counterweight 78 will be removed symmetrically from the counterweight tray 130 with the exception of some of the weights resting on the counterweight tray and lying between trailing counterweight suspension links 136,136. See FIG. 29.

Luffing line 148 is paid out to slack off on carrier/-mast luffing 142 to prevent any tendency of boom foot carrier tension pendants 126 to lift the boom foot carrier. Next the first boom suspension luffing line 162 will be paid out to elongate the first boom suspension linkage 88 to boom down until the boom extends at an angle of between 30° and 45° from the horizontal, depending on the length and the weight of the boom. This additional overturning moment force on the first and second boom suspension linkages will cause the counterweight tray retaining hooks 210 of the counterweight tray support assembly 205 to raise the portion of the support ring assembly 92 being contacted by those hooks to six inches off of the aligned blocking stanchions 94. At this point, the trailing counterweight support travel pendants 139,139 will be pinned to provided openings in the trailing counterweight suspension plates 138,138, and gantry backleg pins 73 will be removed to prevent backleg 72 from taking compression. See FIGS. 30 and 31. The blocking in the form of blocking stanchions 94 can now be removed from the rear half of the ring. The slack is now taken out of the boom foot carrier suspension assembly 80. See FIG. 31.

First boom suspension luffing line 162 is used to boom up to approximately 75°. This will cause the boom foot carrier suspension assembly to go taut because the gantry backleg 72 will not take compresson and because the weight of the boom on the first and second boom suspension linkages 88 and 90 is not large enough to counterbalance the full weight of the remainder of counterweight 78 and the counterweight tray 130. Carrier luffing line 148 will be hoisted in to shorten carrier luffing 142 to lift the front half of the support ring assembly 92 off of the remaining blocking stanchions 94. These stanchions will now be removed. When this has been done, the crane 50 as seen in FIG. 32 is configured for traveling longitudinally of its centerline in either forward or rearward direction.

After the crane and the support ring assembly 92 have been moved to a new prepared location for use, and positioned on appropriate compacted ground and timber surfaces, the crane can be rerigged to its normal operating and working configuration, and reference will be had to FIG. 33 in enumerating the steps and order of steps for doing so.

Figure 5:
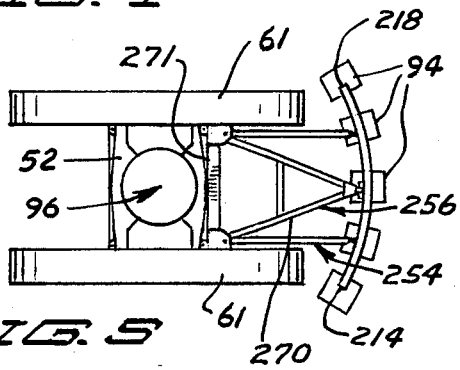

To rig for working, with the crane in its new position, blocking stanchions 94 are placed in the configuration as seen in FIGS. 5, 7 and 9 but under the front half of the support ring 214 only. Carrier luffing 142 is slacked off to allow the outer end of the boom foot carrier 98 to move down to place the front half of the ring 214 on the blocking stanchions.

Boom suspension luffing 156 is slacked off to boom down to between 45° and 30° or until the weight of the boom causes the remainder of the counterweight 78, the counterweight tray 130, and counterweight tray retaining hooks 210 of the counterweight tray support assembly 205 to raise the rear half of the support ring 214 sufficiently to permit the blocking stanchions 94 to be put under the rear half of the ring. The trailing counterweight support travel pendants 139,139 are disconnected from the trailing counterweight suspension plates 138,138, the gantry backleg pins 73 are replaced, and the boom is then raised to allow the back end of the ring to be lowered to position on the rear half of the blocking stanchions 94. The removed counterweight 78 is now replaced symmetrically.

At this point, the lock-up pins 176 can be removed once again returning the crawler crane 50 to its normal operating, working configuration as seen in FIGS. 1 and 26.

What is claimed is:

1. In a crane, said crane having a carbody supported on a generally horizontal surface for forward and rearward movement along its longitudinal axis by a pair of traction assemblies situated on either side of said longitudinal carbody axis, a machinery platform rotatably mounted on the carbody for swinging movement about a vertical machinery platform axis, means for rotating said platform, a support ring supported on a horizontal surface and providing a horizontal ring path in concentric relation to the vertical platform axis, a boom foot carrier pivotably mounted at its inner end to a forward portion of the machinery platform on a horizontal boom foot carrier pivot axis perpendicular to the longitudinal carbody axis and supported at its outer end for movement along the ring path, a boom having a boom foot pivotably mounted to an outer end portion of the carrier on a boom foot pivot axis parallel to the boom foot carrier pivot axis, a mast having a mast foot pivotably mounted to the carrier on a pivot axis parallel to the boom foot carrier pivot axis, a machinery platform first counterweight supported on a rearward portion of the machinery platform, a gantry mounted to the machinery platform to extend generally above the first counterweight, a first boom suspension linkage between upper end portions of the mast and the boom, means for varying the length of said first suspension linkage, a second boom suspension linkage between an upper portion of the gantry and an upper portion of the mast, load handling means, and means including a load line extending over the point of the boom for handling a load on said load handling means, wherein the improvement comprises:

A. a strut assembly extends upwardly from the platform and the carrier, said strut assembly including a rigid compression strut pivotably mounted at a lower end thereof adjacent the boom foot carrier pivot axis on an axis parallel to the carrier pivot axis, and including boom foot carrier tension pendant means connected between an upper end of the compression strut and an outer end portion of the boom foot carrier, the length of said boom foot carrier tension pendant means being such that pivotal movement of said compression strut from a lowered forward position toward an upright position is arrested at such upright position by tensioning said carrier tension pendant means;

B. a boom foot carrier suspension assembly is connected between an upper portion of the gantry and an upper end portion of the compression strut, said carrier suspension assembly including a third suspension linkage connected at its inner end to the gantry, means for varying the length of said third linkage, and boom foot carrier suspension means connected between an outer end of the third suspension linkage and an upper portion of the compression strut; and C. said second boom suspension linkage includes second boom suspension pendant means connected at its upper end to an upper end portion of the mast and includes second boom suspension connecting means operable to connect a lower end of second boom suspension pendant means to the gantry.

2. The structure of claim 1 wherein:

D. said support ring is a rigid structure provided with flange means extending radially beyond said ring path;

E. said boom foot carrier is provided with downwardly extending hook means configured to pass around the support ring flange means to location under said flange means whereby upward movement of the outer end portion of the boom foot carrier will exert lifting forces on said support ring flange means to lift an aligned portion of said support ring from the support of its horizontal surface.

3. The structure of claim 2 wherein:

F. a mast suspension assembly is connected between an upper portion of the gantry and an upper portion of the mast, said mast suspension assembly include said third suspension linkage connected at its inner end to the gantry, said means for varying the length of said third suspension linkage, and mast suspension pendant means connected between the outer end of the third suspension linkage and an upper portion of the mast; and G. said second boom suspension linkage includes second boom suspension pendant means connected at its upper end to the upper end portion of the mast and includes second boom suspension connecting means operable to link a lower end of said second boom suspension pendant means to the counterweight.

4. The structure of claim 1 wherein:

D. the boom foot carrier is supported on roller means for movement along the ring path; and E. the boom foot is pivotably mounted to the boom foot carrier on an outer end portion of the carrier about a boom foot pivot axis between the carrier support roller means and the horizontal boom foot carrier pivot axis to distribute part of the downward thrust on the boom foot to the machinery platform.

5. The structure of claim 4 wherein:

F. the mast foot is pivotably mounted to the boom foot carrier between the carrier support roller means and the boom foot carrier pivot axis to distribute part of the downward thrust on the mast foot to the machinery platform.

6. The structure of claim 5 wherein:

G. at least three percent and not over fifteen percent of the downward thrust on the boom foot carrier due to handling a load is transmitted by the boom foot carrier to the machinery platform.

7. The structure of claim 1 wherein:

D. said compression strut is pivotably mounted at its lower end to an inner end portion of said boom foot carrier.

8. The structure of claim 1 wherein:

D. the strut assembly includes extensible mast stop means connected between an upper end portion of the compression strut and a more rearward portion of the machinery platform, said mast stop means having a minimum longitudinal dimension and a position such that any pivoting of the mast past vertical toward the rear will be arrested by the mast stop means before the point of the mast moves appreciably beyond a position directly vertically over the first counterweight.

9. The structure of claim 1 wherein:

D. a trailing counterweight tray is pivotably mounted at its inner end to the machinery platform on a horizontal pivot axis parallel to the boom foot carrier pivot axis and is supported at its outer end for movement along the ring path;

E. a trailing second counterweight is supported on the trailing counterweight tray;

F. said second boom suspension connecting means includes triangular suspension equalizer plate means connected at a top corner to the lower end of the second boom suspension pendant means and connected at a lower forward corner to an upper portion of the gantry; and G. said second boom suspension linkage also includes trailing counterweight suspension link means connected at its lower end to be in counterweight lifting relation to said trailing counterweight and tray and connected at its upper end to a lower rear corner of said triangular suspension equalizer plate means.

10. The structure of claim 9 wherein:

H. said gantry includes a rigid gantry mast pinned at its lower end to an intermediate portion of said machinery platform for movement about an axis parallel to the boom foot carrier axis, and includes a gantry backleg pinned at its upper end to an upper end of the gantry mast and at its lower end to a rearward portion of said machinery platform, the gantry backleg nominally being a rigid structure of fixed length between pivot points, but including releasable gantry backleg fastening means rendering the gantry backleg collapsible in length when the fastening means is in a release condition.

11. The structure of claim 10 wherein:

I. said support ring is a rigid structure provided with flange means extending radially beyond said ring path;

J. said boom foot carrier and said counterweight tray are each provided with downwardly extending hook means configured to pass around said support ring flange means to location under said flange means whereby upward movement of the outer portions of said boom foot carrier and said counterweight tray will exert lifting forces on said support ring flange means; and K. trailing counterweight support travel pendant means is provided and is pinned at its upper ends to the lower forward corner of the triangular suspension equalizer plate means to nominally hang freely therefrom, said counterweight support travel pendant means being of length and configuration to be fastened into counterweight lifting relation to said trailing counterweight and tray when said second boom suspension linkage is exerting a lifting force on said counterweight tray hook means to lift an aligned portion of said support ring from the support of its horizontal surface.

12. The structure of claim 11 wherein:

L. the rigid support ring includes a plurality of ring segments, each segment including:

(1) a horizontal top flange, a parallel bottom flange and a central web made up of two parallel, spaced-apart curved plates integrally connecting the top and bottom flanges, (2) a pair of immediate flanges each parallel with the top and bottom flanges and each extending circumferentially outwardly from one or the other of the ends of the segment beyond a first of the top and bottom flanges to be in vertically aligned relation with respect to a second of the top and bottom flanges, (3) the size, configuration and positioning of each intermediate flange being such that it lies in parallel, contacting, weight, bearing relation to an intermediate flange of the next adjacent segment; and M. means to fasten each pair of contacting intermediate flanges of adjacent segments to each other includes vertically aligned splicing bolt holes provided through each pair of flanges and splicing bolts passing through said holes.

13. The structure of claim 1 wherein:

D. said boom foot carrier is provided with at least two spaced-apart integral, parallel, upright inner end carrier pivot plates having an aligned first set of horizontal boom foot carrier pivot pin receiving openings therethrough;

E. said machinery platform is provided with at least two spaced-apart, integral, parallel, upright boom foot carrier receiving plates extending integrally outwardly from a forward portion of the machinery platform, said carrier receiving plates having an aligned second set of horizontal boom foot carrier pivot pin receiving openings therethrough;

F. at least one boom foot carrier pivot pin extending through each of said first and second sets of pivot pin receiving openings;

G. the construction and arrangement of the carrier pivot plates and boom foot carrier receiving plates being such as to preclude any appreciable horizontal movement of the carrier pivot plates with respect to the carrier receiving plates;

H. the shape of one of the first and second sets of carrier pin receiving openings in the carrier pivot plates and receiving plates being of dimension to exactly and snugly receive the boom foot carrier pivot pin, and the shape of the other of the two sets of carrier pivot pin receiving openings being of dimension to permit limited vertical movement of the boom foot carrier pivot pin in these other openings to allow limited rotational movement of the boom foot carrier about a longitudinal axis parallel to the longitudinal carbody axis to prevent any deviations from perfectly horizontal in the support ring roller path from transmitting any appreciable twisting moments to the carrier and the machinery platform; and I. means is provided to temporarily prevent all vertical movement of said carrier pivot pin to prevent any rotational movement of said carrier on its longitudinal axis.

14. The structure of claim 13 wherein:

J. said means for temporarily preventing vertical movement of said carrier pivot pin includes at least two lock-up links snugly mounted on opposite end portions of said carrier pivot pin and each lying in adjacent relationship to one of the plates having a vertically elongated carrier pivot pin receiving opening therethrough, a lock-up pin for each adjacent pair of lock-up links and plates with elongated openings, all of said plates with elongated openings and all of said adjacent lock-up links being provided with mutually horizontally aligned lock-up pin receiving openings therethrough of configuration to temporarily snugly receive their associated lock-up pin.

15. In a crane, said crane having a carbody supported on a generally horizontal surface for forward and rearward movement along its longitudinal axis by a pair of traction assemblies situated on either side of said longitudinal carbody axis, a machinery platform rotatably mounted on the carbody for swinging movement about a vertical machinery platform axis, means for rotating said platform, a support ring supported on a horizontal surface and providing a horizontal ring path in concentric relation to the vertical platform axis, a boom foot carrier pivotably mounted at its inner end to a forward portion of the machinery platform on a horizontal boom foot carrier pivot axis perpendicular to the longitudinal carbody axis and supported at its outer end for movement along the ring path, a boom having a boom foot pivotably mounted to an outer end portion of the carrier on a boom foot pivot axis parallel to the boom foot carrier pivot axis, a mast having a mast foot pivotably mounted to the carrier on a pivot axis parallel to the boom foot carrier pivot axis, a machinery platform first counterweight supported on a rearward portion of the machinery platform, a gantry mounted to the machinery platform to extend generally above the first counterweight, a first boom suspension linkage between upper end portions of the mast and the boom, means for varying the length of said first suspension linkage, a second boom suspension linkage between an upper portion of the gantry and an upper portion of the mast, load handling means, and means including a load line extending over the point of the boom for handling a load on said load handling means, wherein the improvement comprises A. a travel strut and mast erection assembly extends upwardly from the platform and the carrier, said assembly including a rigid compression strut pivotably mounted at a lower end thereof adjacent the boom foot carrier pivot axis on an axis parallel to said boom foot carrier pivot axis, and including boom foot carrier tension pendant means connected between an upper end of the compression strut and an outer end portion of the boom foot carrier, the length of the boom foot carrier tension pendant means being such that pivotal movement of said compression strut from a lowered forward position toward an upright position is arrested at such upright position by tensioning said carrier tension pendant means;

B. a boom foot carrier suspension assembly is connected between an upper portion of the gantry and an upper end portion of the travel strut, said carrier suspension assembly including a third suspension linkage connected at its inner end to the gantry, means for varying the length of said third suspension linkage, and boom foot carrier suspension means connected between an outer end of the third suspension linkage and an upper portion of the compression strut;

C. a mast suspension assembly is connected between an upper portion of the gantry and an upper portion of the mast, said mast suspension assembly including said third suspension linkage connected at its inner end to the gantry, said means for varying the length of said third suspension linkage, and mast suspension pendant means connected between the outer end of the third suspension linkage and an upper portion of the mast; and D. said second boom suspension linkage includes second boom suspension pendant means connected at its upper end to the upper end portion of the mast and includes second boom suspension connecting means operable to connect a lower end of said second boom suspension pendant means to the gantry.

16. The structure of claim 15 wherein:

E. said travel strut is pivotably mounted at its lower end to an inner end portion of said boom foot carrier.

17. The structure of claim 15 wherein:

E. a trailing counterweight tray is pivotably mounted at its inner end to the machinery platform on a horizontal pivot axis parallel to the boom foot carrier pivot axis and is supported at is outer end for movement along the ring path;

F. a trailing second counterweight is supported on the trailing counterweight tray;

G. said second boom suspension connecting means includes triangular suspension equalizer plate means connected at a top corner to the lower end of said second boom suspension pendant means and connected at a lower forward corner to an upper portion of the gantry; and H. said second boom suspension linkage also includes trailing counterweight suspension link means connected at its lower end to be in counterweight lifting relation to said trailing counterweight and tray and connected at its upper end to a lower rear corner of said triangular suspension equalizer plate means.

18. The structure of claim 15 wherein:

E. the lengths of said second boom suspension linkage and said mast suspension pendant means are such that said mast suspension pendant means is slack when the boom foot carrier suspension assembly is taut and the second boom suspension pendant means is connected between said upper end portion of the mast and said second boom suspension connecting means.

19. The structure of claim 15 wherein:

E. the travel strut and mast erection assembly includes extensible mast stop means connected between an upper end portion of the compression strut and a more rearward portion of the machinery platform, said mast stop means having a minimum longitudinal dimension and a position such that any pivoting of the mast past vertical toward the rear will be arrested by the mast stop means before the point of the mast moves appreciably beyond a position directly vertically over the first counterweight.

20. The structure of claim 17 wherein:

I. said travel strut is pivotably mounted at its lower end to an inner end portion of said boom foot carrier.

21. The structure of claim 17 wherein:

I. the travel strut and mast erection assembly includes extensible mast stop means connected between an upper end portion of the compression strut and a more rearward portion of the machinery platform, said mast stop means having a minimum longitudinal dimension and a position such that any pivoting of the mast past vertical toward the rear will be arrested by the mast stop means before the point of the mast moves appreciably beyond a position directly vertically over the first counterweight.

22. The structure of claim 17 wherein:

I. the lengths of said second boom suspension linkage and said mast suspension pendant means are such that such mast suspension pendant means is slack when the boom foot carrier suspension assembly is taut and the second boom suspension pendant means is connected between said upper end portion of the mast and said second boom suspension connecting means.

23. The structure of claim 17 wherein:

I. said support ring is a rigid structure provided with flange means extending radially beyond said ring path;

J. said boom foot carrier and said counterweight tray are each provided with downwardly extending hook means positioned to pass around said support ring flange means to location under said flange means whereby upward movement of said boom foot carrier and said counterweight tray will exert lifting forces on said support ring flange means; and K. trailing countwerweight support pendant means is provided and is pinned at its upper ends to the lower forward corner of the triangular suspension equalizer plate means to nominally hang freely therefrom, said counterweight support travel pendant means being of length and configuration to be fastened into counterweight lifting relation to said trailing counterweight and tray when said second boom suspension linkage is exerting a lifting force on said counterweight tray hook means to lift an aligned portion of said support ring from the support of its horizontal surface.

24. The structure of claim 23 wherein:

L. said gantry includes a rigid gantry mast pinned at its lower end to an intermediate portion of said machinery platform for movement about an axis parallel to the boom foot carrier axis, and includes a gantry backleg pinned at its upper end to an upper end of the gantry mast and at its lower end to a rearward portion of said machinery platform, the gantry backleg nominally being a rigid structure of fixed length between pivot points, but including a releasable gantry backleg fastening means rendering the gantry backleg collapsible in length when the fastening means is in a release condition.

25. The structure of claim 24 wherein:

M. said boom foot carrier is provided with at least two spaced-apart integral, parallel, upright inner end carrier pivot plates having an aligned first set of horizontal boom foot carrier pivot pin receiving openings therethrough;

N. said machinery platform is provided with at least two spaced-apart, integral, parallel, upright boom foot carrier receiving plates extending integrally outwardly from a forward portion of the machinery platform, said carrier receiving plates having an aligned second set of horizontal boom foot carrier pivot pin receiving openings therethrough;

O. at least one boom foot carrier pivot pin extending through each of said first and second sets of pivot pin receiving openings;

P. the construction and arrangement of the carrier pivot plates and boom foot carrier receiving plates being such as to preclude any appreciable horizontal movement of the carrier pivot plates with respect to the carrier receiving plates;

Q. the shape of one of the first and second sets of carrier pin receiving openings in the carrier pivot plates and receiving plates being of dimension to exactly and snugly receive the boom foot carrier pivot pin, and the shape of the other of the two sets of carrier pivot pin receiving openings being of dimension to permit limited vertical movement of the boom foot carrier pivot pin in these other openings to allow limited rotational movement of the boom foot carrier about a longitudinal axis parallel to the longitudinal carbody axis to prevent any deviations from perfectly horizontal in the support ring roller path from transmitting any appreciable twisting moments to the carrier and the machinery platform; and R. means is provided to temporarily prevent all vertical movement of said carrier pivot pin to prevent any rotational movement of said carrier or its longitudinal axis when said machinery platform is transporting said ring.

26. The structure of claim 25 wherein:

R. said means for temporarily restricting vertical movement of said carrier pivot pin includes at least two lock-up links snugly mounted on opposite end portions of said carrier pivot pin and each lying in adjacent relationship to one of the plates having a vertically elongated carrier pivot pin receiving opening therethrough, a lock-up pin for each adjacent pair of lock-up links and plates with elongated openings, all of said plates with elongated openings and all of said adjacent lock-up links being provided with mutually horizontally aligned lock-up pin receiving openings therethrough of configuration to temporarily snugly receive their associated lock-up pin.

27. In a crane, said crane having a carbody supported on a generally horizontal surface for forward and rearward movement along its longitudinal axis by a pair of traction assemblies situated on either side of said longitudinal carbody axis, a machinery platform rotatably mounted on the carbody for swinging movement about a vertical machinery platform axis, means for rotating said platform, a support ring supported on a horizontal surface and providing a horizontal ring path in concentric relation to the vertical platform axis, a boom foot carrier pivotably mounted at its inner end to a forward portion of the machinery platform on a horizontal boom foot carrier pivot axis perpendicular to the longitudinal carbody axis and supported at its outer end for movement along the ring path, a boom having a boom foot pivotably mounted to an outer end portion of the carrier on a boom foot pivot axis parallel to the boom foot carrier pivot axis, a mast having a mast foot pivotably mounted to the carrier on a pivot axis parallel to the boom foot carrier pivot axis, a first counterweight supported to rotate with the machinery platform, a gantry mounted to a rearward portion of the machinery platform, a first boom suspension linkage between upper end portions of the mast and the boom, means for varying the length of said first suspension linkage, a second boom suspension linkage between the first counterweight and an upper portion of the mast, load handling means, and means including a load line extending over the point of the boom for handling a load on said load handling means, wherein the improvement comprises:

A. a strut assembly extends upwardly from the platform and the carrier, said strut assembly including a rigid compression strut pivotably mounted at a lower end thereof adjacent the boom foot carrier pivot axis on an axis parallel to the carrier pivot axis, and including boom foot carrier tension pendant means connected between an upper end of the compression strut and an outer end portion of the boom foot carrier, the length of said boom foot carrier tension pendant means being such that pivotal movement of said compression strut from a lowered forward position toward an upright position is arrested at such upright position by tensioning said carrier tension pendant means;

B. a boom foot carrier suspension assembly is connected between an upper portion of the gantry and an upper end portion of the compression strut, said carrier suspension assembly including a third suspension linkage connected at its inner end to the gantry, means for varying the length of said third linkage, and boom foot carrier suspension means connected between an outer end of the third suspension linkage and an upper portion of the compression strut; and C. said second boom suspension linkage includes second boom suspension pendant means connected at its upper end to an upper end portion of the mast and includes second boom suspension connecting means operable to connect a lower end of second boom suspension pendant means to said gantry and counterweight.

28. The structure of claim 27 wherein:

D. said support ring is a rigid structure provided with flange means extending radially beyond said ring path;

E. said boom foot carrier is provided with downwardly extending hook means configured to pass around the support ring flange means to location under said flange means whereby upward movement of the outer end portion of the boom foot carrier will exert lifting forces on said support ring flange means to lift an aligned portion of said support ring from the support of its horizontal surface.

29. The structure of claim 28 wherein:

F. a mast suspension assembly is connected between an upper portion of the gantry and an upper portion of the mast, said mast suspension assembly including said third suspension linkage connected at its inner end to the gantry, said means for varying the length of said third suspension linkage, and mast suspension pendant means connected between the outer end of the third suspension linkage and an upper portion of the mast; and G. said second boom suspension linkage includes second boom suspension pendant means connected at its upper end to the upper end portion of the mast and includes second boom suspension connecting means operable to link a lower end of said second boom suspension pendant means to the counterweight.

30. The structure of claim 2 wherein:

D. said support ring provides a complete circular ring path in concentric relation to said vertical platform axis; and E. means is provided for positioning and maintaining said support ring in concentric relation to this vertical machinery platform axis of rotation on the carbody, said means including:

(1) a plurality of elongated locating struts each pivotably mounted on a horizontal axis at an inner end thereof with respect to one of said carbody and said traction assemblies and pivotably mounted at its outer end on a horizontal axis to said support ring, (2) at least two of said locating struts being pivotably mounted with respect to a forward end of said carbody and extending outwardly to said support ring in parallel relation to each other and to the longitudinal axis of said carbody, (3) at least two of said locating struts being pivotably mounted with respect to a rearward end of the carbody and extending outwardly to said support ring in parallel relation to each other and to the longitudinal axis of said carbody, and (4) at least two of said locating struts being pivotably mounted with respect to each of the traction assemblies, each pair of traction assembly mounted locating struts lying in parallel relationship to each other and in transverse relationship to the longitudinal axis of the carbody.

31. The structure of claim 30 wherein:

F. at least one of the locating struts including a hollow tube, a pair of oppositely threaded turnbuckle bolts threadably mounted in opposite ends of the tube, and means to pivotably mount the turnbuckle bolts at each end of the strut to the carbody/traction assemblies and to the support ring in such a manner as to preclude longitudinal movement of the turnbuckle bolts with respect to that to which they are pivotably mounted.

32. The structure of claim 30 wherein:

F. means is provided to inhibit and prevent rotational movement of the support ring about the carbody, said means including front and rear shear struts each having a pair of converging shear strut legs fixedly attached at inner ends thereof with repect to substantially spaced-apart portions of one of the front and rear ends of the carbody, each leg converging toward the other to meet the other adjacent to the support ring, outer ends of the converging legs being fixedly attached to the support ring in alignment with the longitudinal axis of the carbody.

33. The structure of claim 32 wherein:

G. each of said shear struts includes a base leg extending in transverse direction to the longitudinal axis of the carbody in parallel adjacent relationship to the carbody, said base leg being integrally and rigidly connected to inner ends of each of the converging strut legs; and H. the outer ends of said converging shear struts are rigidly attached to each other to provide an outwardly extending tongue portion in longitudinal alignment with the longitudinal axis of the carbody.

34. The structure of claim 33 wherein:

I. means is provided for accurately aligning a predetermined point on the support ring with the longitudinal axis of said carbody, said means including:

(1) two bracket arms extending horizontally outwardly from the support ring in direction toward the carbody and situated in spaced relation to each other, one on either side of said predetermined point on the support ring, and (2) bolt means threadably mounted with respect to each of said support arms and adjustably associated with the shear strut tongue to position and hold said tongue portion of said converged legs into aligned relation with said predetermined point on said support ring.

35. The structure of claim 11 wherein:

K. said support ring provides a complete circular ring path in concentric relation to said vertical platform axis; and L. means is provided for positioning and maintaining said support ring in concentric relation to this vertical machinery platform axis of rotation on the carbody, said means including:

(1) a plurality of elongated locating struts each pivotably mounted on a horizontal axis at an inner end thereof with respect to one of said carbody and said traction assemblies and pivotably mounted at its outer end on a horizontal axis to said support ring, (2) at least two of said locating struts being pivotably mounted with respect to a forward end of said carbody and extending outwardly to said support ring in parallel relation to each other and to the longitudinal axis of said carbody, (3) at least two of said locating struts being pivotably mounted with respect to a rearward end of the carbody and extending outwardly to said support ring in parallel relation to each other and to the longitudinal axis of said carbody, (4) at least two of said locating struts being pivotably mounted with respect to each of the traction assemblies, each pair of traction assembly mounted locating struts lying in parallel relationship to each other and in transverse relationship to the longitudinal axis of the carbody, and (5) means is provided to selectively forceably elongate and shorten the effective length of each of the locating struts to the end that the length of the struts can be varied as needed to change the position of the support ring to achieve substantially exact concentric alignment between the support ring and the vertical machinery platform rotation axis.

36. The structure of claim 35 wherein:

M. at least one of the locating struts including a hollow tube, a pair of oppositely threaded turnbuckle bolts threadably mounted in opposite ends of the tube, and means to pivotably mount the turnbuckle bolts at each end of the strut to the carbody/traction assemblies and to the support ring in such a manner as to preclude longitudinal movement of the turnbuckle bolts with respect to that to which they are pivotably mounted.

37. The structure of claim 35 wherein:

M. means is provided to inhibit and prevent rotational movement of the support ring about the carbody, said means including front and rear shear struts each having a pair of converging shear strut legs fixedly attached at inner ends thereof with repect to substantially spaced-apart portions of one of the front and rear ends of the carbody, each leg converging toward the other to meet the other adjacent to the support ring, outer ends of the converging legs being fixedly attached to the support ring in alignment with the longitudinal axis of the carbody.

38. The structure of claim 37 wherein:

N. each of said shear struts includes a base leg extending in transverse direction to the longitudinal axis of the carbody in parallel adjacent relationship to the carbody, said base leg being integrally and rigidly connected to inner ends of each of the converging strut legs; and O. the outer ends of said converging shear struts are rigidly attached to each other to provide an outwardly extending tongue portion in longitudinal alignment with the longitudinal axis of the carbody.

39. The structure of claim 38 wherein:

P. means is provided for accurately aligning a predetermined point on the support ring with the longitudinal axis of said carbody, said means including:

(1) two bracket arms extending horizontally outwardly from the support ring in direction toward the carbody and situated in spaced relation to each other, one on either side of said predetermined point on the support ring, and (2) bolt means threadably mounted with respect to each of said support arms and adjustably associated with the shear strut tongue to position and hold said tongue portion of said converged legs into aligned relation with said predetermined point on said support ring.

40. The structure of claim 23 wherein:

L. said support ring provides a complete circular ring path in concentric relation to said vertical platform axis; and M. means is provided for positioning and maintaining said support ring in concentric relation to this vertical machinery platform axis of rotation on the carbody, said means including:

(1) a plurality of elongated locating struts each pivotably mounted on a horizontal axis at an inner end thereof with respect to one of said carbody and said traction assemblies and pivotably mounted at its outer end on a horizontal axis to said support ring, (2) at least two of said locating struts being pivotably mounted with respect to a forward end of said carbody and extending outwardly to said support ring in parallel relation to each other and to the longitudinal axis of said carbody, (3) at least two of said locating struts being pivotably mounted with respect to a rearward end of the carbody and extending outwardly to said support ring in parallel relation to each other and to the longitudinal axis of said carbody, (4) at least two of said locating struts being pivotably mounted with respect to each of the traction assemblies, each pair of traction assembly mounted locating struts lying in parallel relationship to each other and in transverse relationship to the longitudinal axis of the carbody, and (5) means is provided to selectively forceably elongate and shorten the effective length of each of the locating struts to the end that the length of the struts can be varied as needed to change the position of the support ring to achieve substantially exact concentric alignment between the support ring and the vertical machinery platform rotation axis.

41. The structure of claim 40 wherein:

N. at least one of the locating struts including a hollow tube, a pair of oppositely threaded turnbuckle bolts threadably mounted in opposite ends of the tube, and means to pivotably mount the turnbuckle bolts at each end of the strut to the carbody/traction assemblies and to the support ring in such a manner as to preclude longitudinal movement of the turnbuckle bolts with respect to that to which they are pivotably mounted.

42. The structure of claim 40 wherein:

N. means is provided to inhibit and prevent rotational movement of the support ring about the carbody, said means including front and rear shear struts each having a pair of converging shear strut legs fixedly attached at inner ends thereof with repect to substantially spaced-apart portions of one of the front and rear ends of the carbody, each leg converging toward the other to meet the other adjacent to the support ring, outer ends of the converging legs being fixedly attached to the support ring in alignment with the longitudinal axis of the carbody.

43. The structure of claim 42 wherein:

O. each of said shear struts includes a base leg extending in transverse direction to the longitudinal axis of the carbody in parallel adjacent relationship to the carbody, said base leg being integrally and rigidly connected to inner ends of each of the converging strut legs; and P. the outer ends of said converging shear struts are rigidly attached to each other to provide an outwardly extending tongue portion in longitudinal alignment with the longitudinal axis of the carbody.

44. The structure of claim 43 wherein:

Q. means is provided for accurately aligning a predetermined point on the support ring with the longitudinal axis of said carbody, said means including:

(1) two bracket arms extending horizontally outwardly from the support ring in direction toward the carbody and situated in spaced relation to each other, one on either side of said predetermined point on the support ring, and (2) bolt means threadably mounted with respect to each of said support arms and adjustably associated with the shear strut tongue to position and hold said tongue portion of said converged legs into aligned relation with said predetermined point on said support ring.

45. The structure of claim 25 wherein:

S. said support ring provides a complete circular ring path in concentric relation to said vertical platform axis; and T. means is provided for positioning and maintaining said support ring in concentric relation to this vertical machinery platform axis of rotation on the carbody, said means including:

(1) a plurality of elongated locating struts each pivotably mounted on a horizontal axis at an inner end thereof with respect to one of said carbody and said traction assemblies and pivotably mounted at its outer end on a horizontal axis to said support ring, (2) at least two of said locating struts being pivotably mounted with respect to a forward end of said carbody and extending outwardly to said support ring in parallel relation to each other and to the longitudinal axis of said carbody, (3) at least two of said locating struts being pivotably mounted with respect to a rearward end of the carbody and extending outwardly to said support ring in parallel relation to each other and to the longitudinal axis of said carbody, (4) at least two of said locating struts being pivotably mounted with respect to each of the traction assemblies, each pair of traction assembly mounted locating struts lying in parallel relationship to each other and in transverse relationship to the longitudinal axis of the carbody, and (5) means is provided to selectively forceably elongate and shorten the effective length of each of the locating struts to the end that the length of the struts can be varied as needed to change the position of the support ring to achieve substantially exact concentric alignment between the support ring and the vertical machinery platform rotation axis.

46. The structure of claim 45 wherein:

U. at least one of the locating struts including a hollow tube, a pair of oppositely threaded turnbuckle bolts threadably mounted in opposite ends of the tube, and means to pivotably mount the turnbuckle bolts at each end of the strut to the carbody/traction assemblies and to the support ring in such a manner as to preclude longitudinal movement of the turnbuckle bolts with respect to that to which they are pivotably mounted.

47. The structure of claim 45 wherein:

U. means is provided to inhibit and prevent rotational movement of the support ring about the carbody, said means including front and rear shear struts each having a pair of converging shear strut legs fixedly attached at inner ends thereof with repect to substantially spaced-apart portions of one of the front and rear ends of the carbody, each leg converging toward the other to meet the other adjacent to the support ring, outer ends of the converging legs being fixedly attached to the support ring in alignment with the longitudinal axis of the carbody.

48. The structure of claim 47 wherein:

V. each of said shear struts includes a base leg extending in transverse direction to the longitudinal axis of the carbody in parallel adjacent relationship to the carbody, said base leg being integrally and rigidly connected to inner ends of each of the converging strut legs; and W. the outer ends of said converging shear struts are rigidly attached to each other to provide an outwardly extending tongue portion in longitudinal alignment with the longitudinal axis of the carbody.

49. The structure of claim 48 wherein:

X. means is provided for accurately aligning a predetermined point on the support ring with the longitudinal axis of said carbody, said means including:

(1) two bracket arms extending horizontally outwardly from the support ring in direction toward the carbody and situated in spaced relation to each other, one on either side of said predetermined point on the support ring, and (2) bolt means threadably mounted with respect to each of said support arms and adjustably associated with the shear strut tongue to position and hold said tongue portion of said converged legs into aligned relation with said predetermined point on said support ring.

* * * * *

UNITED STATES PATENT AND TRADEMARK OFFICE

CERTIFICATE OF CORRECTION

PATENT NO. : 4,579,234

DATED : April 1, 1986

INVENTOR(S) : Pierre C. Delago et al

It is certified that error appears in the above-identified patent and that said Letters Patent is hereby corrected as shown below:

In claim 3, line 37, the word "include" should read --including--.

In claim 23, line 38, the word "countwerweight" should read --counterweight--.

In claim 35, line 48, the word "forceably" should read --forcibly--.

Signed and Sealed this

*Eighth* Day of *July 1986*

[SEAL]

*Attest:*

DONALD J. QUIGG

*Attesting Officer*

*Commissioner of Patents and Trademarks*